US010227820B2

(12) United States Patent
Kanno et al.

(10) Patent No.: US 10,227,820 B2
(45) Date of Patent: Mar. 12, 2019

(54) DAYLIGHTING SLAT AND DAYLIGHTING DEVICE

(71) Applicant: SHARP KABUSHIKI KAISHA, Sakai, Osaka (JP)

(72) Inventors: Toru Kanno, Sakai (JP); Shun Ueki, Sakai (JP); Tsuyoshi Kamada, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 37 days.

(21) Appl. No.: 15/322,283

(22) PCT Filed: Jul. 2, 2015

(86) PCT No.: PCT/JP2015/069091

§ 371 (c)(1),
(2) Date: Dec. 27, 2016

(87) PCT Pub. No.: WO2016/002869

PCT Pub. Date: Jan. 7, 2016

(65) Prior Publication Data

US 2017/0138124 A1 May 18, 2017

(30) Foreign Application Priority Data

Jul. 2, 2014 (JP) ..... 2014-136581

(51) Int. Cl.
*E06B 9/386* (2006.01)
*E06B 9/24* (2006.01)
(Continued)

(52) U.S. Cl.
CPC ..... *E06B 9/386* (2013.01); *E06B 9/30* (2013.01); *E06B 9/303* (2013.01);
(Continued)

(58) Field of Classification Search
CPC ..... F21S 11/002; F21S 11/007; E06B 2009/2405
(Continued)

(56) References Cited

U.S. PATENT DOCUMENTS 9,708,847 B2 * 7/2017 Kashiwagi ..... E06B 9/24
2014/0016191 A1 1/2014 Yeh et al.
(Continued)

FOREIGN PATENT DOCUMENTS

EP 2644801 A1 * 10/2013 ..... E04D 13/0315
EP 2662621 A2 * 11/2013 ..... F21V 33/006
(Continued)

OTHER PUBLICATIONS

International Search Report for PCT/JP2015/069091, dated Aug. 25, 2015, 4 pages.
(Continued)

*Primary Examiner* — Christopher E Mahoney
(74) *Attorney, Agent, or Firm* — ScienBiziP, P.C.

(57) ABSTRACT

A daylighting slat (4) includes: a daylighting plate (51); and a support member (24) that supports the daylighting plate (51), in which the daylighting plate (51) includes; a base that has light transparency; and a plurality of daylighting parts that are provided on a first surface of the base, have light transparency, and form a gap portion between the plurality of daylighting parts, in which a part of a side surface of a daylighting part, which is in contact with the gap portion, functions as a reflecting surface that reflects light entering the daylighting part, and the support member (24), at least a part of which has light transparency, includes a gripping portion (25) that grips at least a part of a peripheral part of the daylighting plate (51) and has light absorbability, and a protective plate (26) formed of a plate body that is provided so as to face a first surface or a second surface of the daylighting plate (51).

15 Claims, 30 Drawing Sheets

(51) Int. Cl.
*E06B 9/30* (2006.01)
*E06B 9/303* (2006.01)

(52) U.S. Cl.
CPC ..... *E06B 2009/2405* (2013.01); *E06B 2009/2417* (2013.01); *E06B 2009/2423* (2013.01); *E06B 2009/2441* (2013.01)

(58) Field of Classification Search
USPC ..... 160/168.1 V
See application file for complete search history.

(56) References Cited

U.S. PATENT DOCUMENTS

2015/0226394 A1* 8/2015 Ueki ..... E06B 9/386 359/595
2016/0097502 A1* 4/2016 Padiyath ..... F21S 11/00 359/592
2017/0114972 A1* 4/2017 Padiyath ..... F21S 11/007
2017/0146207 A1* 5/2017 Nishinaka ..... F21S 11/007
2017/0146208 A1* 5/2017 Ueki ..... E06B 9/24
2017/0314752 A1* 11/2017 Yui ..... F21S 11/007
2017/0356611 A1* 12/2017 Vasylyev ..... F21S 11/002
2017/0362883 A1* 12/2017 Kanno ..... E06B 3/67

FOREIGN PATENT DOCUMENTS

FR 3010427 A1 * 3/2015 ..... G09F 15/0018
JP 58-041178 3/1983
JP 63-098993 6/1988
JP 09-054274 2/1997
JP 2003-129772 5/2003
JP 2007-146395 6/2007
JP 2014-015831 1/2014

OTHER PUBLICATIONS

Written Opinion of the ISA for PCT/JP2015/069091, dated Aug. 25, 2015, 5 pages.

* cited by examiner

X-X' CROSS SECTION

DAYLIGHTING SLAT AND DAYLIGHTING DEVICE

TECHNICAL FIELD

The present invention relates to a daylighting slat and a daylighting device.

This application is the national phase of International Application No. PCT/JP2015/069091, filed Jul. 2, 2015 which designated the U.S. and claims priority to Japanese Patent Application No. 2014-136581 filed in Japan on Jul. 2, 2014, the entire content of each of which are hereby incorporated herein by reference.

BACKGROUND ART

In an office, for example, since natural outdoor light (sunlight) enters inside a building (room) through window glass or the like, a person in the building is dazzled in some cases. Thus, for example, in order to prevent a person from being dazzled during work or from a viewpoint of security and privacy protection, there is a case where a blind, a curtain, or the like is arranged in front of window glass. Thereby, it is possible to shield light entering through the window glass and prevent peeping the inside of a room through the window glass.

Currently, a method by which, by using a daylighting member having a microstructure for a slat of a blind, external light in the daytime is efficiently taken and radiated toward a ceiling in a room or the like has been proposed (for example, PTL 1).

As performance which is required for a blind, importance is attached to an angle adjustment function, storability, mechanical strength, thinness, and a lightweight property of a slat, or the like.

In PTL 1, a configuration in which an assembly configured by putting a light guiding film between a discolorable element and a light shielding element, each of which has a film-like shape, is provided in a slat via a seat is disclosed. With this configuration, strength of the assembly having a film-like shape is secured by the seat.

CITATION LIST

Patent Literature

PTL 1: Japanese Unexamined Patent Application Publication No. 2014-15831

SUMMARY OF INVENTION

Technical Problem

In order to improve strength of a daylighting member to be used for a slat, there has been a method of changing a sectional shape of a microstructure to a rigid one or increasing a thickness of a member of the daylighting member. However, in a case where the microstructure of the daylighting member has a special sectional shape, a problem that storability is deteriorated is caused, and, in a case where the thickness of the daylighting member is increased, for example, a problem that a lightweight property is degraded is caused.

An aspect of the invention is made in view of such problems of conventional techniques, and an object thereof is to provide a daylighting device which includes a slat having higher rigidity while securing storability and weight reduction of the slat, and a daylighting slat suitably used for such a daylighting device.

Solution to Problem

A daylighting slat of an aspect of the invention may be configured to include: a daylighting plate; and a support member that supports the daylighting plate, in which the daylighting plate includes; a base that has light transparency; and a plurality of daylighting parts that are provided on a first surface of the base, have light transparency, and form a gap portion between the plurality of daylighting parts, in which a part of a side surface of a daylighting part, which is in contact with the gap portion, functions as a reflecting surface that reflects light entering the daylighting part, and the support member, at least a part of which has light transparency, includes a gripping portion that grips at least a part of a peripheral part of the daylighting plate and has light absorbability, and a protective plate formed of a plate body that is provided so as to face a first surface or a second surface of the daylighting plate.

A daylighting slat of an aspect of the invention may be configured to include: a daylighting plate; and a support member that supports the daylighting plate, in which the daylighting plate includes; a base that has light transparency; and a plurality of daylighting parts that are provided on a first surface of the base, have light transparency, and form a gap portion between the plurality of daylighting parts, in which a part of a side surface of a daylighting part, which is in contact with the gap portion, functions as a reflecting surface that reflects light entering the daylighting part, and the support member, at least a part of which has light transparency, includes a gripping portion that grips at least a part of a peripheral part of the daylighting plate and has a light diffusing property, and a protective plate formed of a plate body that is provided so as to face a first surface or a second surface of the daylighting plate.

A daylighting slat of an aspect of the invention may be configured to include: a daylighting plate; and a support member that supports the daylighting plate, in which the daylighting plate includes; a base that has light transparency; and a plurality of daylighting parts that are provided on a first surface of the base, have light transparency, and form a gap portion between the plurality of daylighting parts, in which a part of a side surface of a daylighting part, which is in contact with the gap portion, functions as a reflecting surface that reflects light entering the daylighting part, and the support member includes a gripping portion that grips at least a part of a peripheral part of the daylighting plate and has light transparency, and a protective plate formed of a plate body that is provided so as to face a first surface or a second surface of the daylighting plate and has light transparency.

The daylighting slat of an aspect of the invention may have a configuration in which the daylighting plate and the protective plate face each other via an air layer.

The daylighting slat of an aspect of the invention may have a configuration in which the protective plate has a light diffusing property.

The daylighting slat of an aspect of the invention may have a configuration in which a light diffusing layer is provided on a side opposite to the protective plate with the daylighting plate arranged therebetween.

The daylighting slat of an aspect of the invention may have a configuration in which a thickness of the protective plate changes along a transverse direction of the protective plate.

The daylighting slat of an aspect of the invention may have a configuration in which the protective plate has ultraviolet absorbability, an ultraviolet reflecting property, or an infrared reflecting property.

The daylighting slat of an aspect of the invention may have a configuration in which the daylighting plate includes a plurality of daylighting plates configurations of which are different from each other.

A daylighting device of an aspect of the invention includes: a plurality of slats; and a support mechanism that couples the plurality of slats so as to set a longitudinal direction of the slats to be in a horizontal direction and supports the plurality of slats in a hanging manner in a vertical direction, in which at least a part of the plurality of slats is constituted by the aforementioned daylighting slat.

The daylighting device of an aspect of the invention may have a configuration in which the support mechanism supports the plurality of slats so as to be able to be lifted and lowered.

The daylighting device of an aspect of the invention may have a configuration in which the support mechanism supports the plurality of slats such that tilt thereof is able to be adjusted.

The daylighting device of an aspect of the invention may have a configuration in which the daylighting slat is provided for a part in an upper part side in the vertical direction among the plurality of slats.

The daylighting device of an aspect of the invention may be configured to include: a first daylighting slat that is provided for a part in an upper part side in the vertical direction among the plurality of slats; and a second daylighting slat that is provided for a part in a lower part side in the vertical direction, in which light transmittance of the protective plate in the second daylighting slat is lower than light transmittance of the protective plate in the first daylighting slat.

The daylighting device of an aspect of the invention may have a configuration in which the support member includes a first section that supports the daylighting part and a second section that is not positioned in a same plane as a first surface or a second surface of the daylighting part.

The daylighting device of an aspect of the invention may have a configuration in which, in a fully closed state, an overlap part of the slats that are adjacent to each other in the vertical direction is only the gripping portion.

Advantageous Effects of Invention

As described above, according to an aspect of the invention, it is possible to provide a daylighting device capable of taking natural outdoor light (sunlight) into a building efficiently and illuminating the deep inside of the building without causing a person in the building to be dazzled, and a daylighting slat suitably used for such a daylighting device.

DESCRIPTION OF EMBODIMENTS

Description will hereinafter be given for embodiments of the invention with reference to drawings.

Note that, in each of the drawings used for the description below, the scale of each member is changed as appropriate in order to make the each member easy to understand.

First Embodiment

First, as a first embodiment of the invention, a daylighting device 1 illustrated in FIG. 1 will be described, for example.

Figure 1:
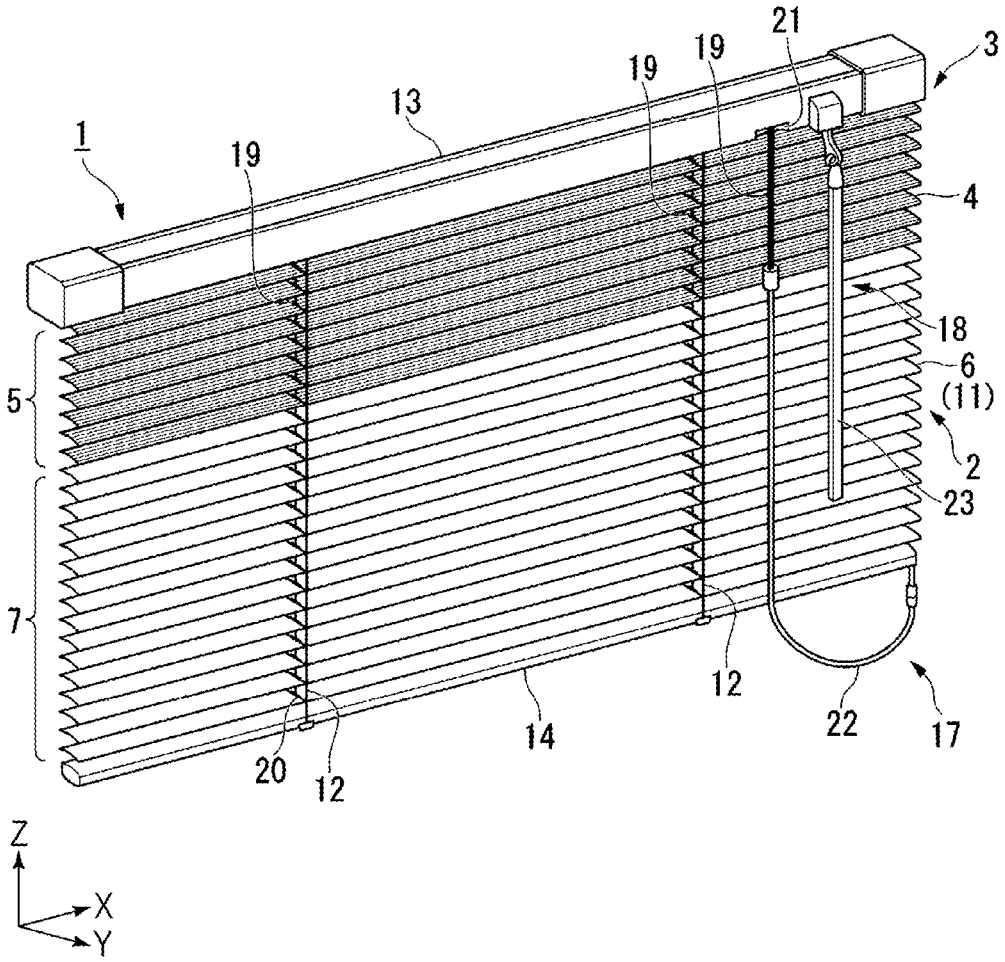
FIG. 1 is a perspective view illustrating an appearance of a daylighting device.

Note that, FIG. 1 is a perspective view illustrating an appearance of the daylighting device 1. In the following description, the positional relation (up and down, right and left, front and back) of the daylighting device 1 is based on the positional relation (up and down, right and left, front and back) of the daylighting device 1 in use, and unless otherwise described, the positional relation of the daylighting device 1 also coincides with the positional relation in the page surface of the drawing.

It is set that, in FIG. 1, an up-and-down direction of the daylighting device 1 is a Z direction, a right-and-left direction thereof is an X direction, and a back-and-forth direction thereof is a Y direction.

As illustrated in FIG. 1, the daylighting device 1 is a blind mainly constituted by a plurality of slats 2 arranged in parallel in a horizontal direction (X direction) with a gap therebetween, and a support mechanism 3 which supports the plurality of slats 2 in a vertical direction (Z direction) so as to hang freely. The plurality of slats 2 are supported so as to be lifted and lowered freely and the plurality of slats 2 are supported so as to tilt freely in the daylighting device 1.

The plurality of slats 2 have a daylighting portion 5 including a plurality of daylighting slats 4 each having a daylighting property, and a light shielding portion 7 which is positioned under the daylighting portion 5 and includes a plurality of light shielding slats 6 each having a light shielding property. Note that, in the following description, if there is no need to particularly discriminate the daylighting slats 4 from the light shielding slats 6, both are treated as the slats 2 collectively.

Figure 2:
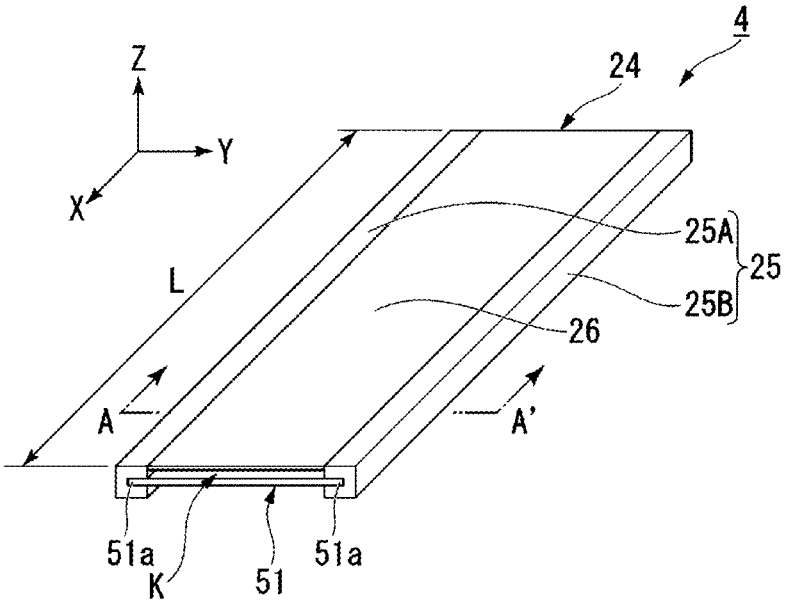
FIG. 2 is a perspective view illustrating a schematic configuration of a daylighting slat.

FIG. 2 is a perspective view illustrating a schematic configuration of a daylighting slat.

Figure 3:
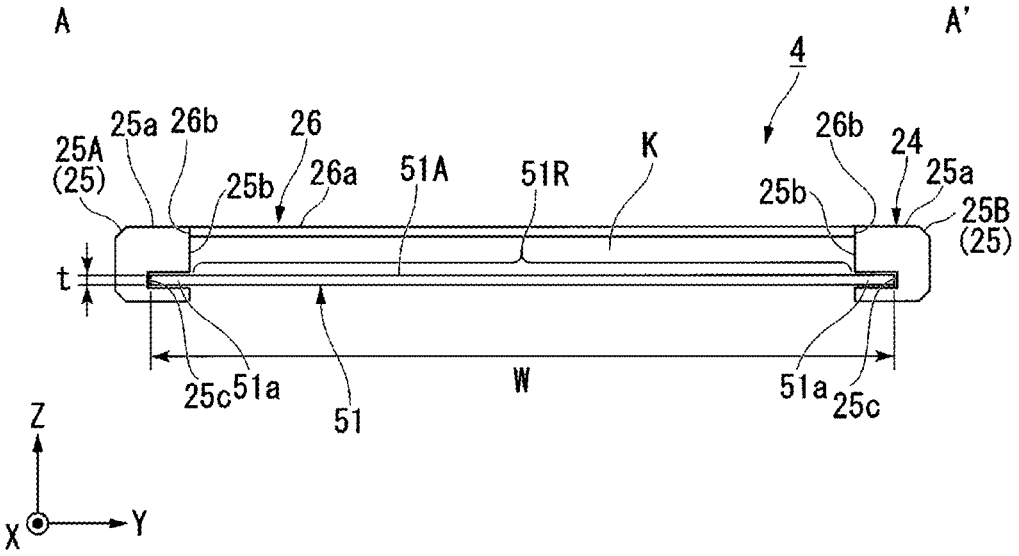
FIG. 3 is a sectional view taken along an A-A' line of FIG. 2.

FIG. 3 is a sectional view taken along an A-A' line of FIG. 2.

As illustrated in FIG. 2 and FIG. 3, each of the daylighting slats 4 constituting the daylighting portion 5 includes a daylighting plate 51 and a support member 24 which supports the daylighting plate 51.

The support member 24 is configured by including a gripping portion 25 which grips at least a part of a peripheral part of the daylighting plate 51 and has light absorbability, and a protective plate 26 formed of a plate body which is provided so as to face a microstructure surface 51A of the daylighting plate 51 and has light transparency. In the present embodiment, each of side parts 51*a* and 51*a* on both sides of the daylighting plate 51 in a transverse direction (Y direction) is gripped by the gripping portion 25.

As illustrated in FIG. 2 and FIG. 3, the gripping portion 25 has a configuration in which a first gripping portion 25A and a second gripping portion 25B which are coupled with the protective plate 26 grip the side parts 51*a* and 51*a* of the daylighting plate 51. In each of the first gripping portion 25A and the second gripping portion 25B, over the whole in a longitudinal direction thereof, a groove 25*c* into which either of the side parts 51*a* and 51*a* of the daylighting plate 51 is inserted is formed. A dimension configuration of the groove 25*c* is set correspondingly to a shape of the daylighting plate 51. For example, the shape of the daylighting plate 51 has a thickness t=1 mm, a length L=1000 mm, and a width W=25 mm. Note that, a thickness of the gripping portion 25 is about 3 mm, for example.

The gripping portion 25 (the first gripping portion 25A and the second gripping portion 25B) is able to be manufactured by a profile extrusion manufacturing method. This manufacturing method allows formation of a sectional shape which is successive in one direction, so that it is easy to adjust a length.

A material for forming the gripping portion 25 is not particularly limited as long as being a material having light absorbability. In the case of forming the gripping portion 25 by using a material having light transparency, there is a possibility that stray light is generated due to scattering of entered sunlight, so that a material which does not have light transparency or has light transparency but is colored is selected in the present embodiment. Since a member which is colored and has light transparency has a characteristic that a light transmittance thereof is low, it is possible to suppress stray light. A material such as a resin or a metal or a color is not limited particularly.

In addition, a material having flexibility, such as an elastomer, has a configuration with which the daylighting portion 5 is easily held, and is therefore preferable.

The protective plate 26 is formed of a plate material having, in a plan view, a size enough to cover at least a daylighting region 51R (a region in which a plurality of daylighting projections 9 described below are formed) of the daylighting plate 51. The protective plate 26 is connected to the first gripping portion 25A and the second gripping portion 25B each of which is arranged on either of the both sides in the transverse direction, and couples them. The protective plate 26 is fixed, for example, in a state where side end surfaces 26*b* and 26*b* on the both sides in the transverse direction are in contact with inner surfaces 25*b* and 25*b* of the first gripping portion 25A and the second gripping portion 25B, respectively. In the present embodiment, a front surface 26*a* of the protective plate 26 is flush with each of top surfaces 25*a* and 25*a* of the first gripping portion 25A and the second gripping portion 25B, but there is no limitation thereto.

A material of the protective plate 26 is not limited particularly as long as being a material having light transparency, which has a high transparency of visible light. Examples thereof include polycarbonate (PC), an acrylic resin (PMMA), polyvinyl chloride (PVC), polyethylene terephthalate (PET), and the like.

Figure 4A:
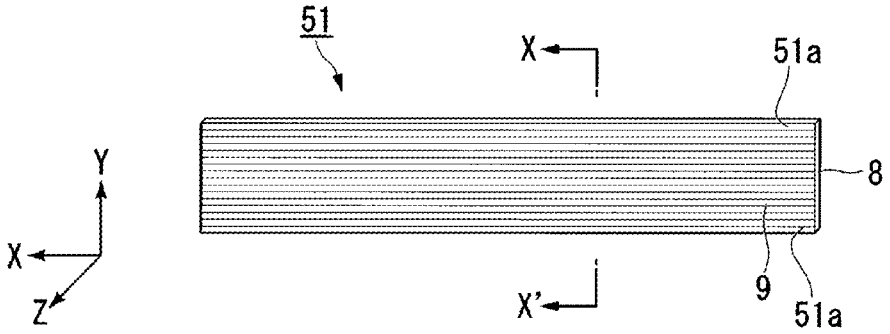
FIG. 4A is a plan view illustrating a schematic configuration of a daylighting plate.
Figure 4B:
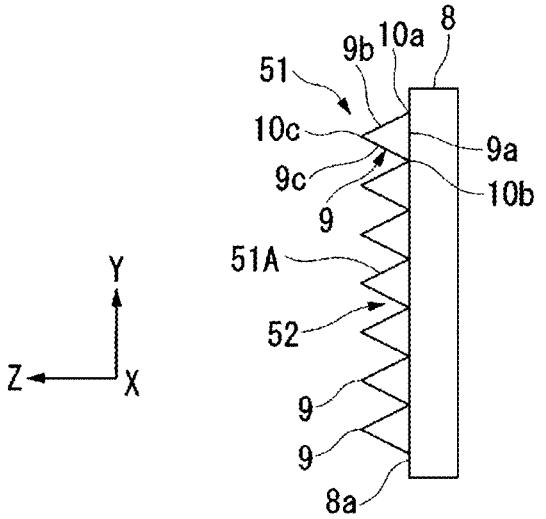
FIG. 4B is a sectional view taken along an X-X line of FIG. 4A.

FIG. 4A is a plan view illustrating a schematic configuration of the daylighting plate, and FIG. 4B is a sectional view taken along an X-X line of FIG. 4A.

As illustrated in FIG. 4A and FIG. 4B, the daylighting plate 51 has a base 8 which has light transparency and is long, the plurality of daylighting projections 9 which are formed side by side on a first surface 8*a* of the base 8 and have light transparency, and a gap portion 52 which is provided between the plurality of daylighting projections 9. The plurality of daylighting projections 9 may be formed on the whole of the first surface 8*a* of the base 8, or may be formed only in the above-described daylighting region 51R (FIG. 3) which is a region excluding the side parts 51*a* and 51*a* each of which is held by the groove 25*c* of the gripping portion 25.

The base 8 is formed of a light transparent resin such as a thermoplastic polymer, a thermosetting resin, or a photopolymerizable resin. As the light transparent resin, those made from an acrylic polymer, an olefin polymer, a vinyl polymer, a cellulose polymer, an amide polymer, a fluorine polymer, a urethane polymer, a silicone polymer, an imide polymer, and the like may be used. Among them, for example, a polymethyl methacrylate resin (PMMA), triacetylcellulose (TAC), polyethylene terephthalate (PET), cycloolefin polymer (COP), polycarbonate (PC), polyethylene naphthalate (PEN), polyether sulphone (PES), polyimide (PI), or the like is suitably used. A total light transmittance of the base 8 is preferably equal to or greater than 90% in accordance with JIS K7361-1. Thereby, it is possible to obtain sufficient transparency.

Each of the daylighting projections 9 is formed of an organic material having light transparency and photosensitivity, such as an acrylic resin, an epoxy resin, or a silicone resin, for example. In addition, one in which the organic material is mixed with a polymerization initiator, a coupling agent, a monomer, an organic solvent, and the like may be used. Further, the polymerization initiator may contain various additional components, such as a stabilizer, an inhibitor, a plasticizer, a fluorescent brightener, a release agent, a chain transfer agent, and other photopolymerizable monomers. Additionally, a material described in Japanese Patent No. 4129991 may be used. The total light transmittance of the daylighting projections 9 is preferably equal to or greater than 90% in accordance with its K7361-1. Thereby, it is possible to obtain sufficient transparency.

The plurality of daylighting projections 9 extend in a longitudinal direction (X direction) of the base 8 and are provided side by side in a transverse direction (Y direction) of the base 8. Each of the daylighting projections 9 forms a prism with a triangular cross section. Specifically, the daylighting projection 9 has a first surface part 9*a* which faces the first surface 8*a* of the base 8, a second surface part 9*b* which is adjacent to the first surface part 9*a* with a first corner part 10*a* arranged therebetween, and a third surface part (a reflecting surface: a side surface) 9*c* which is adjacent to the first surface part 9*a* with a second corner part 10*b*, which is on a side opposite to the first corner part 10*a*, arranged therebetween and is adjacent to the second surface part 9*b* with a third corner part 10*c* arranged therebetween.

Here, air (gap portion 52) exists in each space between the plurality of daylighting projections 9, so that the second surface part 9*b* and the third surface part 9*c* serve as an interface between constituent materials of the daylighting projection 9 and the air. This space may be filled with another low-refractive-index material. However, a difference of refractive indexes of the interface between the inside and the outside of the daylighting projection 9 becomes the greatest when the air exists, compared to a case where any low-refractive-index material exists in the outside. Accordingly, when the air exists, a critical angle of light totally reflected by the second surface part 9*b* or the third surface part 9*c* is the smallest of light entering the daylighting projection 9 in accordance with Snell's law. Thereby, a range of an incident angle of the light totally reflected by the second surface part 9*b* or the third surface part 9*c* is the largest, so that it is possible to guide the light entering the daylighting projection 9 to the other surface side of the base 8 efficiently. As a result, loss of the light entering the daylighting projection 9 is suppressed and luminance of light output from the other surface of the base 8 is able to be enhanced.

Note that, a refractive index of the base 8 and the refractive index of the daylighting projection 9 are desired to be almost equal. This is because, for example, in a case where the refractive index of the base 8 and the refractive index of the daylighting projection 9 are greatly different, when light enters the base 8 from the daylighting projection 9, unnecessary refraction or reflection of light may be caused in an interface between the daylighting projection 9 and the base 8. In this case, there is a possibility of causing defects, for example, that a desired daylighting property is not obtained or luminance is reduced.

In addition, the plurality of daylighting projections 9 are able to be formed on the base 8 by using, for example, a photolithography technique as a method for producing the daylighting plate 51. The daylighting plate 51 is able to be produced by a method such as a melt extrusion method, an extrusion method, or an imprinting method in addition to the method using the photolithography technique. The base 8 and the daylighting projections 9 are integrally formed of the same resin when by the method such as the melt extrusion method or the extrusion method.

Description will return to FIG. 1. Each of the light shielding slats 6 constituting the light shielding portion 7 is formed of a base 11 in a long plate shape having a light shielding property. The base 11 is only required to be one generally used as a so-called slat for a blind, and may be made of metal, wood, or resin, for example. For example, the base 11 may be obtained by applying coating or the like to a surface thereof.

The support mechanism 3 includes a plurality of ladder cords 12 arranged in parallel in a vertical direction (a transverse direction of the plurality of slats 2), a fixation box 13 for supporting upper ends of the plurality of ladder cords 12, and a lifting and lowering bar 14 attached to lower ends of the plurality of ladder cords 12.

Figure 5A:
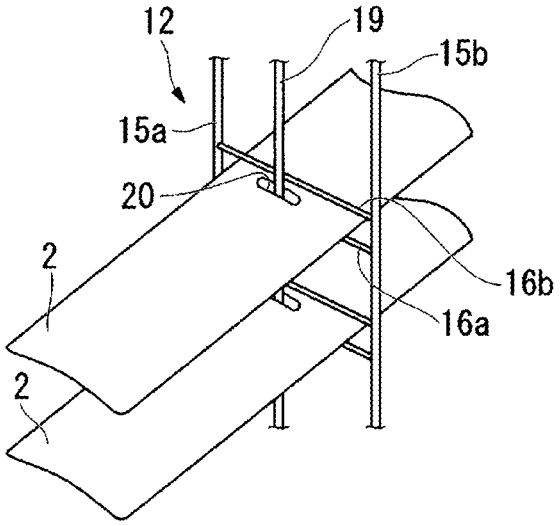
FIG. 5A is a perspective view of an enlarged main part of the daylighting device illustrated in FIG. 1, which is in an opened state.
Figure 5B:
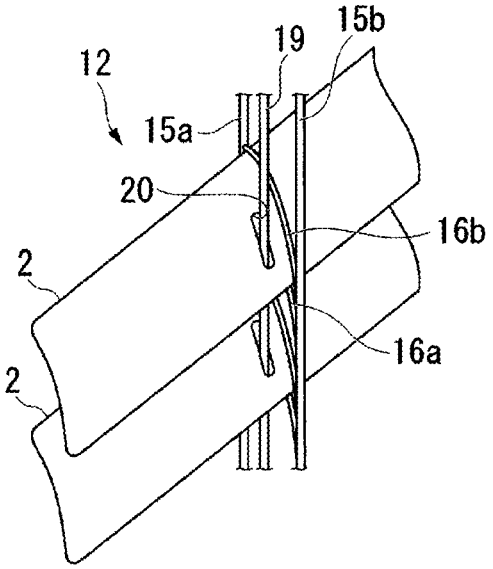
FIG. 5B is a perspective view of the enlarged main part of the daylighting device illustrated in FIG. 1, which is in a closed state.

FIG. 5A and FIG. 5B are perspective views of an enlarged main part of the daylighting device 1, in which FIG. 5A illustrates a state where each space between the slats 2 is opened and FIG. 5B illustrates a state where each space between the slats 2 is closed.

A pair of ladder cords 12 are arranged side by side in right and left sides across center parts of the plurality of slats 2. As illustrated in FIG. 5A and FIG. 5B, each of the ladder cords 12 has a pair of front and back vertical cords 15*a* and 15*b* arranged parallel to each other, and a pair of upper and lower horizontal cords 16*a* and 16*b* stretched between the vertical cords 15*a* and 15*b*, and has a configuration in which the horizontal cords 16*a* and 16*b* are arranged at an equal interval in a longitudinal direction (vertical direction) of the vertical cords 15*a* and 15*b*. Each of the slats 2 is arranged being inserted between the vertical cords 15*a* and 15*b* and between the horizontal cords 16*a* and 16*b*.

As illustrated in FIG. 1, the fixation box 13 is positioned at the uppermost part of the plurality of slats 2 arranged parallel to each other, and is arranged parallel to the plurality of slats 2. On the other hand, the lifting and lowering bar 14 is positioned at the lowermost part of the plurality of slats 2 arranged parallel to each other, and is arranged parallel to the plurality of slats 2. The vertical cords 15*a* and 15*b* constituting each of the ladder cords 12 are hung from the fixation box 13 in a state of being pulled downward in the vertical direction due to the own weight of the lifting and lowering bar 14.

The support mechanism 3 includes a lifting and lowering operation portion 17 for performing an operation of lifting or lowering the plurality of slats 2, and a tilting operation portion 18 for performing an operation of tilting the plurality of slats 2.

The lifting and lowering operation portion 17 has a plurality of lifting and lowering cords 19 as illustrated in FIG. 1, FIG. 5A, and FIG. 5B. The plurality of lifting and lowering cords 19 are arranged parallel to and side by side with the vertical cords 15*a* and 15*b* which constitute the ladder cords 12. The plurality of lifting and lowering cords 19 have lower ends attached to the lifting and lowering bar 14 in a state of penetrating through holes 20 formed in the respective slats 2.

The plurality of lifting and lowering cords 19 have upper end sides pulled around inside the fixation box 13 and are pulled out from a window 21 provided on one side of the fixation box 13. The lifting and lowering cords 19 pulled out from the window 21 are connected to one end of an operation cord 22. The other end of the operation cord 22 is attached to one end of the lifting and lowering bar 14.

In the lifting and lowering operation portion 17, by pulling the operation cord 22 in a state where the lifting and lowering bar 14 is positioned at the lowermost part, the lifting and lowering cords 19 are pulled into the fixation box 13. Thereby, the plurality of slats 2 overlap on the lifting and lowering bar 14 from the lower side in turn to be lifted with the lifting and lowering bar 14. The lifting and lowering cords 19 are fixed by a stopper (not illustrated) provided inside the window 21. This makes it possible to fix the lifting and lowering bar 14 at any height. To the contrary, when the fixation of the lifting and lowering cords 19 by the stopper is released, the lifting and lowering bar 14 is able to be lowered by its own weight. Thereby, the lifting and lowering bar 14 is able to be positioned at the lowermost part again.

The tilting operation portion 18 has an operation lever 23 on one side of the fixation box 13 as illustrated in FIG. 1. The operation lever 23 is attached so as to rotate freely about a shaft. In the tilting operation portion 18, by rotating the operation lever 23 about the shaft, the vertical cords 15*a* and 15*b* constituting the ladder cords 12 illustrated in FIG. 5A are able to be operated so as to move vertically in a reverse direction of each other. Thereby, the plurality of slats 2 are able to be tilted in synchronization with each other between the state where each space between the slats 2 is opened as illustrated in FIG. 5A and the state where each space between the slats 2 is closed as illustrated in FIG. 5B.

The daylighting device 1 configured as described above is arranged being hung from an upper part of window glass or the like with the plurality of slats 2 facing an inner surface of the window glass. In addition, the daylighting portion 5 is arranged in a state where a surface of each of the daylighting slats 4, on which the daylighting projections 9 are formed, faces the window glass.

Figure 6:
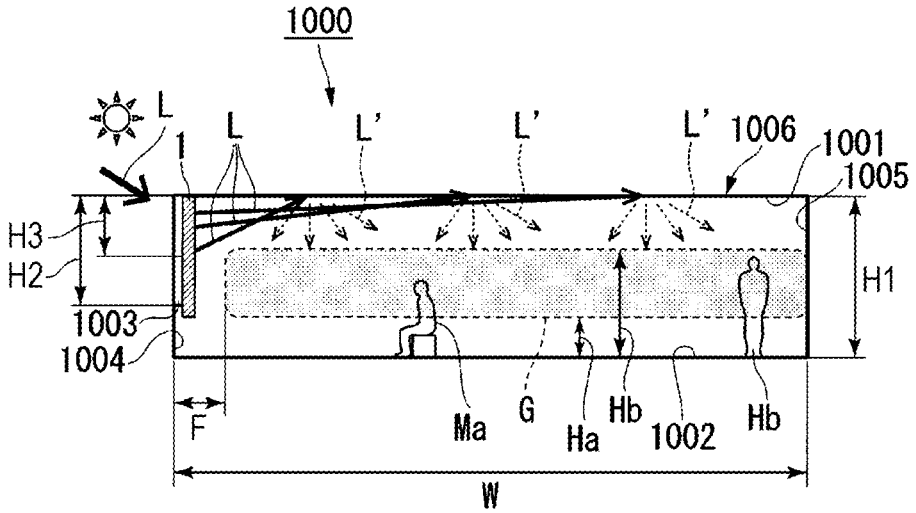
FIG. 6 is a schematic view illustrating an example of a room model in which the daylighting device is installed.

Here, functions of the daylighting portion 5 and the light shielding portion 7 of the daylighting device 1 will be described with the use of a room model 1000 illustrated in FIG. 6. FIG. 6 is a schematic view illustrating an example of the room model 1000 in which the daylighting device 1 is installed.

The room model 1000 is a model assuming that, for example, the daylighting device 1 is used in an office. Specifically, the room model 1000 illustrated in FIG. 6 represents a case where, through window glass 1003, outdoor light L enters obliquely downward a room 1006 surrounded by a ceiling 1001, a floor 1002, a nearest side wall 1004 to which the window glass 1003 is attached, and a farthest side wall 1005 facing the nearest side wall 1004. The daylighting device 1 is arranged in a state of facing an inner surface of the window glass 1003.

In the room model 1000, a height dimension of the room 1006 (dimension from the ceiling 1001 to the floor 1002) H1 is 2.7 m, a lengthwise dimension H2 of the window glass 1003 is 1.8 m from the ceiling 1001, a lengthwise dimension H3 of the daylighting portion 5 is 0.6 m from the ceiling 1001, and a depth dimension of the room 1006 (dimension from the nearest side wall 1004 to the farthest side wall 1005) W is 16 m.

In the room model 1000, there are a person Ma sitting on a chair in the middle of the room 1006 and a person Mb standing on the floor 1002 in the deep inside of the room 1006. An eye level Ha of the person Ma sitting on the chair is 0.8 m from the floor 1002, and an eye level Hb of the person Mb standing on the floor 1002 is 1.8 m from the floor 1002.

A region (hereinafter, referred to as a glare region) G where the persons Ma and Mb in the room 1006 are dazzled is in a range of the eye levels Ha and Hb of the persons Ma and Mb in the room. In addition, a vicinity of the window glass 1003 in the room 1006 serves as a region F in which the outdoor light L is directly radiated mainly through the window glass 1003. This region F is in a range of 1 m from the nearest side wall 1004. Accordingly, in a height range of 0.8 m to 1.8 m from the floor 1002, the glare region G is in a range from a position of 1 m away from the nearest side wall 1004 to the farthest side wall 1005 excluding the region F.

Figure 7:
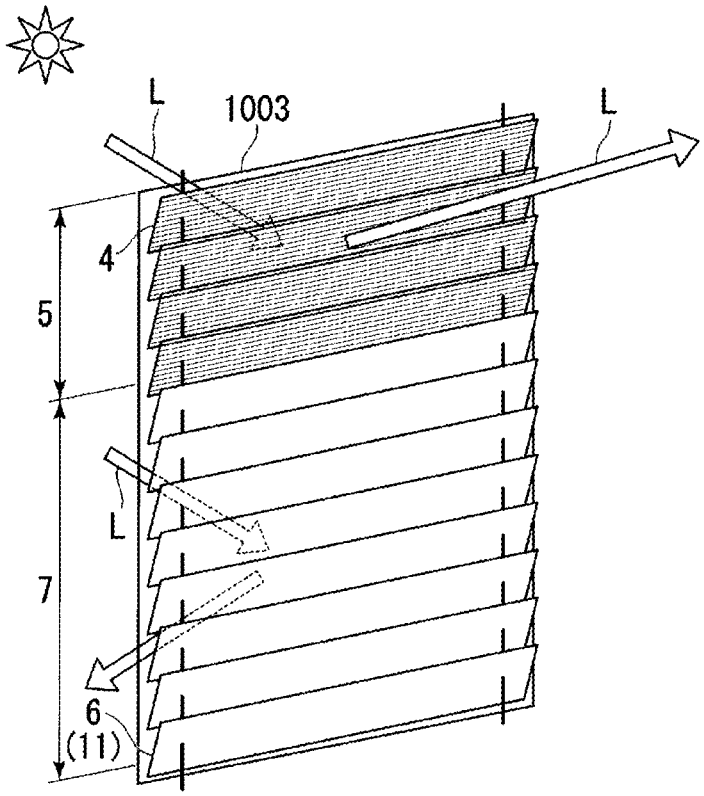
FIG. 7 is a perspective view for explaining functions of a daylighting portion and a light shielding portion which are provided in the daylighting device illustrated in FIG. 1.
Figure 8A:
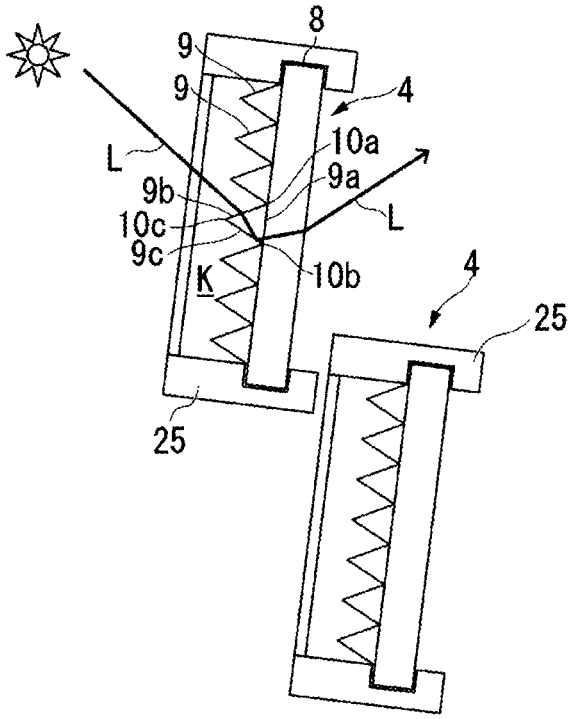
FIG. 8A is a side view for explaining a function of daylighting slats constituting the daylighting portion.

In the daylighting portion 5, as illustrated in FIG. 6 and FIG. 7, the light L entering an inside of each of the daylighting slats 4 obliquely downward on one surface thereof is output from the other surface of each of the daylighting slats 4 to an outside in an obliquely upward direction. Specifically, in each of the daylighting slats 4, as illustrated in FIG. 8A, the light L entering each of the daylighting projections 9 from the second surface part 9*b* is totally reflected by the third surface part 9*c* and then output from the other surface of the base 8 as the light L traveling to the ceiling 1001.

Figure 8B:
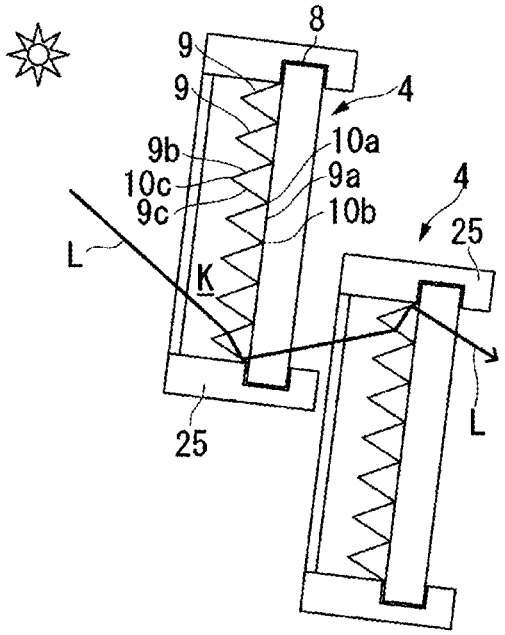
FIG. 8B is a view illustrating an optical path in a case where an overlap width of the daylighting slats is wide.

In a case where an overlap width of the daylighting slats 4 is wide as illustrated in FIG. 8B, there is a possibility that glare is generated due to light which has passed through the daylighting slat 4 twice or more.

Figure 8C:
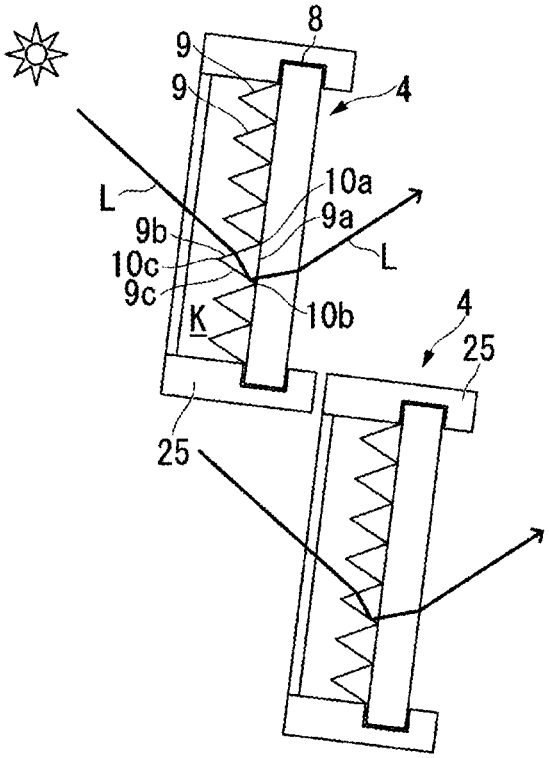
FIG. 8C is a view illustrating an optical path in a case where the overlap width of the daylighting slats is narrow.

Thus, the most preferable mode is a configuration in which only the gripping portions 25 of the daylighting slats 4 adjacent in the vertical direction overlap with each other as illustrated in FIG. 8C. In this case, since sunlight passes through the daylighting slat 4 only once, it is possible to suppress the glare. Further, there is no need to worry that light which has passed through the daylighting slat 4 is shielded by the gripping portion 25 of another daylighting slat 4.

Thereby, it is possible to relatively enhance luminance of light traveling to the ceiling 1001 while reducing luminance of light traveling to the glare region G and light traveling to the floor 1002 of the light L entering the room 1006 through the window glass 1003 as illustrated in FIG. 6. That is, the light L entering the room 1006 through the window glass 1003 is able to be radiated efficiently toward the ceiling 1001. It is also possible to radiate the light L traveling to the ceiling 1001 to the deep inside of the room 1006 without causing the persons Ma and Mb in the room 1006 to be dazzled.

Further, light L' reflected by the ceiling 1001 is to illuminate the room 1006 brightly over a wide range instead of illumination light. In this case, by turning off lighting equipment in the room 1006, an energy saving effect for saving energy consumed by the lighting equipment in the room 1006 in the daytime is able to be expected.

On the other hand, in the light shielding portion 7, as illustrated in FIG. 6 and FIG. 7, the light L entering the inside of each of the light shielding slats 6 obliquely downward on one surface thereof is shielded by each of the light shielding slats 6. Being positioned under the daylighting portion 5, the light shielding portion 7 is able to mainly shield light traveling to the glare region G and light traveling to the floor 1002 of the light L entering the room 1006 through the window glass 1003.

Figure 9A:
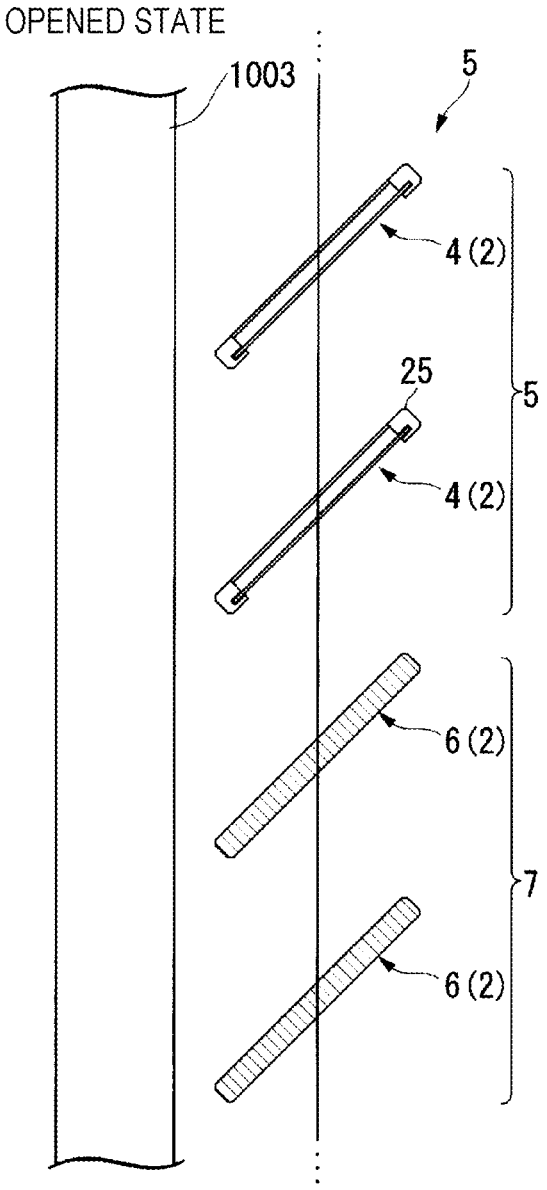
FIG. 9A is a first side view for explaining a function of light shielding slats constituting the light shielding portion.
Figure 9B:
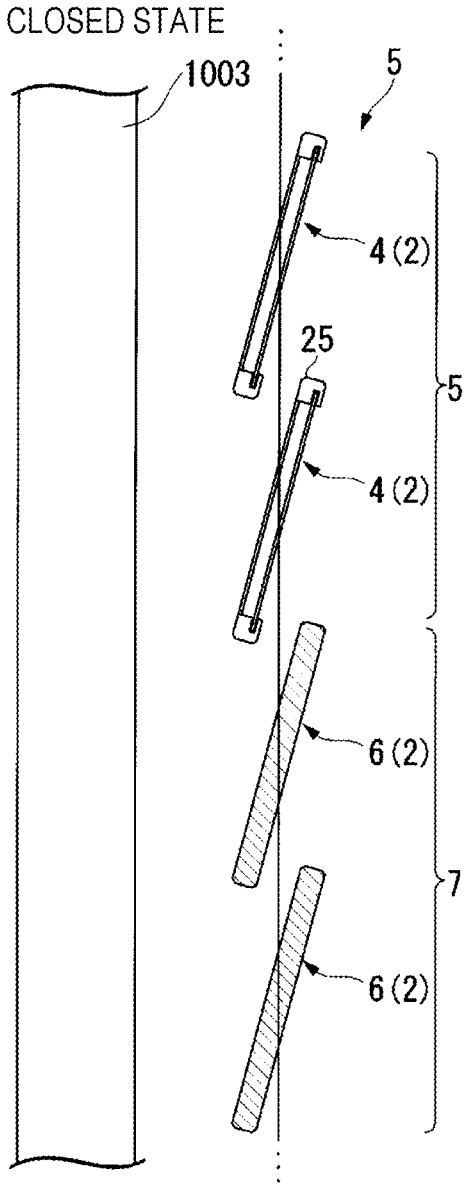
FIG. 9B is a second side view for explaining the function of the light shielding slats constituting the light shielding portion.
Figure 9C:
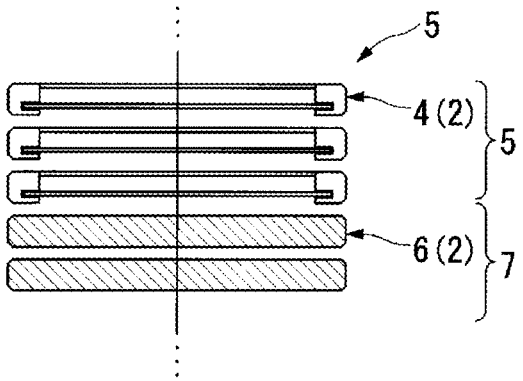
FIG. 9C is a third side view for explaining the function of the light shielding slats constituting the light shielding portion.

FIG. 9A to FIG. 9C are side views for explaining a function of the light shielding slats 6 constituting the light shielding portion 7, in which FIG. 9A illustrates a state where each space between the slats 2 is opened, FIG. 9B illustrates a state where each space between the slats 2 is closed, and FIG. 9C illustrates a state where the respective slats 2 are stored.

As illustrated in FIG. 9A and FIG. 9B, in the daylighting device 1, by performing the tilting operation of the plurality of slats 2, an angle of the light L traveling to the ceiling is able to be adjusted by the daylighting portion 5. On the other hand, in the light shielding portion 7, by performing the tilting operation of the plurality of slats 2, it is possible to adjust the light L entering from each space between the light shielding slats 6 or to see an outside situation through the window glass 1003 from each space between the light shielding slats 6.

Moreover, since "JIS A4801 Steel and aluminum alloy venetian blinds" specifies that, when having a width of 35 mm or more, the slat 2 needs to have an overlap part not less than 3 mm, and, when having a width less than 35 mm, needs to have an overlap part not less than 2 mm, and that the slats 2 need to prevent seeing the other side when viewed in a horizontal direction in a fully closed state, each interval between the slats 2 in the closed state of FIG. 9B is preferably a slat interval with which the specification of JIS is satisfied and only the gripping portions 25 overlap.

In the daylighting device 1, as illustrated in FIG. 9C, for example, when the lifting and lowering bar 14 is positioned at a border between the daylighting portion 5 and the light shielding portion 7 by lifting the lifting and lowering bar 14 while overlapping the plurality of slats 2 from the lower side, a region of the window glass 1003, which faces the light shielding portion 7, is able to be brought into an exposed state. Further, when the lifting and lowering bar 14 is lifted to the uppermost part, the entire surface of the window glass 1003 is able to be exposed.

As described above, when the daylighting device 1 of the present embodiment is used, it is possible to radiate the light L entering the room 1006 through the window glass 1003 toward the ceiling 1001 of the room 1006 by the plurality of daylighting slats 4 constituting the daylighting portion 5 and to shield the light L traveling to the glare region G by the plurality of light shielding slats 6 constituting the light shielding portion 7.

Thus, with the daylighting device 1, it is possible to take outdoor natural light (sunlight) into the room 1006 efficiently through the daylighting portion 5 and make the persons Ma and Mb in the room 1006 feel bright at the deep inside of the room 1006 without being dazzled. On the other hand, the light shielding portion 7 is able to shield the light entering from the window glass 1003 and prevent peeping into the room 1006 through the window glass 1003.

As illustrated in FIG. 2 and FIG. 3, the daylighting slat 4 of the present embodiment has a configuration in which a microstructure side of the daylighting plate 51 is covered with the support member 24, so that it is possible to prevent the microstructures of the daylighting slats 4 from being in contact with each other at a time of an opening/closing operation or storage, and prevent a user from touching the microstructure at a time of use. As a result thereof, it is possible to protect the microstructure of the daylighting plate 51 for a long term.

In a case where the daylighting plate 51 having a thickness of about 0.5 to 1.0 mm is used alone as the daylighting slat 4, a problem due to long-term use, such as bending, is to be caused, but, with a configuration in which the daylighting plate 51 is supported by the support member 24 in a plane state, it is possible to prevent a secular change of the daylighting plate 51. As described above, by inserting the side parts 51*a* and 51*a* on the both sides of the daylighting plate 51 into the grooves 25*c* and 25*c* of the gripping portion 25, the daylighting slat 4 has a hollow structure in which an air layer K exists between the daylighting plate 51 and the protective plate 26. Thus, the microstructure of the daylighting plate 51 is not buried in an inside of an adhesive between the daylighting plate 51 and the protective plate 26, so that, in a state where a daylighting function is sufficiently achieved, it is possible to provide a configuration which is light and mechanical strength of which is high. As above, it is possible to realize weight reduction of the daylighting plate 51 while securing rigidity of the daylighting plate 51.

In addition, in order to prevent the daylighting plate 51 from bending or falling off, each of the side parts 51*a* and 51*a* of the daylighting plate 51 may be fixed by being bonded to the groove 25*c* of the gripping portion 25. Additionally, the daylighting plate 51 may be prevented from bending or falling off with a configuration in which the daylighting plate 51 is tensioned in a width direction.

Note that, the invention is not necessarily limited to the configuration of the daylighting device 1 described as the first embodiment and may be variously changed without departing from the gist of the invention.

Here, modified examples of the support member are illustrated in FIG. 10A to FIG. 10E and FIG. 11.

FIG. 10A to FIG. 10E are sectional views illustrating the modified examples of the support member.

Figure 10A:
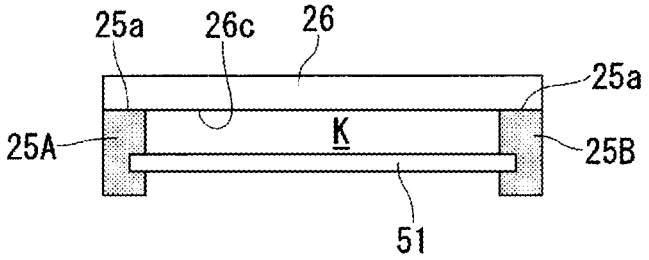
FIG. 10A is a first sectional view illustrating a modified example of a support member.

For example, as illustrated in FIG. 10A, a configuration in which a side of a rear surface 26*c* of the protective plate 26 is fixed to a top surface 25*a* of each of the first gripping portion 25A and the second gripping portion 25B may be provided.

Figure 10B:
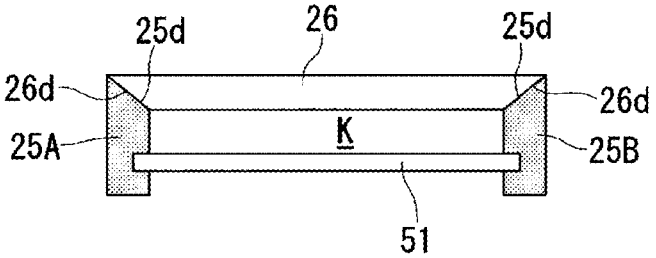
FIG. 10B is a second sectional view illustrating a modified example of the support member.

Moreover, as illustrated in FIG. 10B, a configuration in which tapered surfaces 26*d* and 26*d* which are provided on both sides of the protective plate 26 in a transverse direction are fixed to inclined surfaces 25*d* and 25*d* which are provided in upper parts of the first gripping portion 25A and the second gripping portion 25B, respectively, may be provided.

Figure 10C:
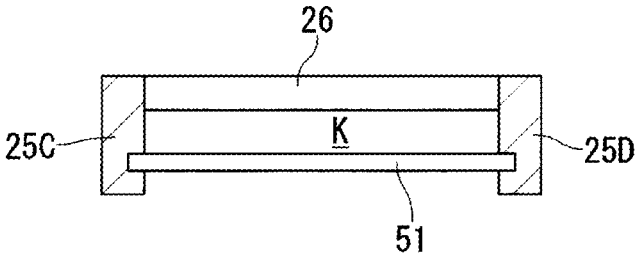
FIG. 10C is a third sectional view illustrating a modified example of the support member.

In addition, as illustrated in FIG. 10C, each of a first gripping portion 25C and a second gripping portion 25D which are coupled with each other via the protective plate 26 may be made of a metal member.

Figure 10D:
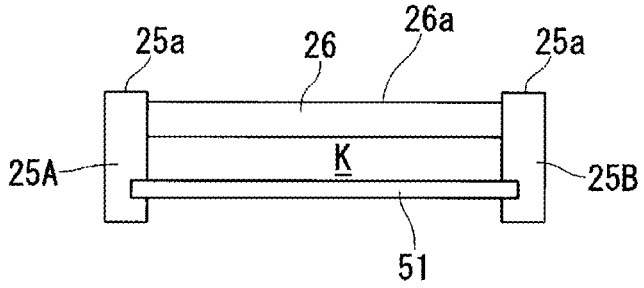
FIG. 10D is a fourth sectional view illustrating a modified example of the support member.

Further, as illustrated in FIG. 10D, the front surface 26*a* of the protective plate 26 and the respective top surfaces 25*a* and 25*a* of the first gripping portion 25A and the second gripping portion 25B are not necessarily flush, as long as arrangement such that the air layer K is formed between the protective plate 26 and the daylighting plate 51 is provided.

Figure 10E:
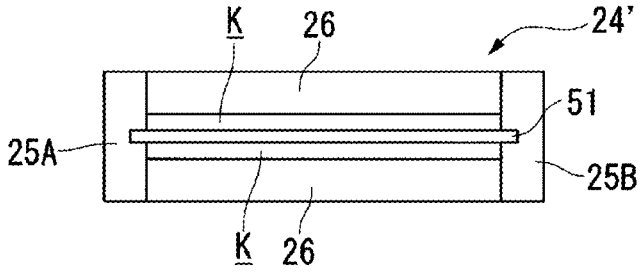
FIG. 10E is a fifth sectional view illustrating a modified example of the support member.

Furthermore, as illustrated in FIG. 10E, a configuration in which, by using a pair of protective plates 26 and 26, both surface sides of the daylighting plate 51 are protected may be provided. The pair of protective plates 26 and 26 are fixed to the first gripping portion 25A and the second gripping portion 25B so as to face each other via the daylighting plate 51. The air layer K is formed in each space between the protective plates 26 and 26 and the daylighting plate 51, so that a support member 24' has a hollow structure.

Figure 11:
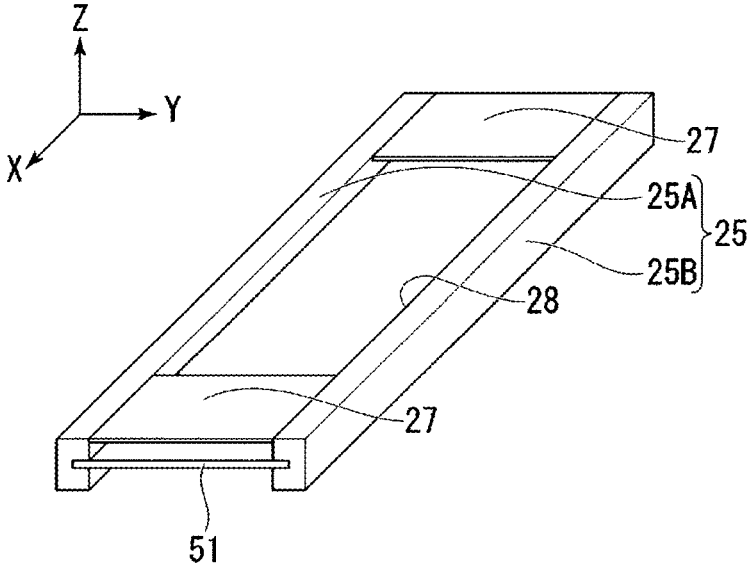
FIG. 11 is a perspective view illustrating a modified example of the support member.

Note that, the support member 24 only needs to have a configuration in which at least one part has light transparency, and, for example, as illustrated in FIG. 11, a configuration in which at least end parts on both sides of the first gripping portion 25A and the second gripping portion 25B in a longitudinal direction are coupled with coupling members 27 may be provided. A configuration in which a transparent member is embedded in an opening 28 defined by the first gripping portion 25A and the second gripping portion 25B and the adjacent coupling members 27 may be provided, or the opening 28 may be left as it is.

Moreover, the number, the size, and the like of the slats 2 are able to be changed appropriately in accordance with a size of the window glass 1003. Since the ladder cords 12 support the plurality of slats 2 in a state of being parallel to each other, the number of arrangement thereof is also able to be increased accordingly.

The daylighting device 1 is configured so that, among the plurality of slats 2, the plurality of daylighting slats 4 constituting the daylighting portion 5 are arranged on an upper part side and the plurality of light shielding slats 6 constituting the light shielding portion 7 are arranged on a lower part side, but the configuration is not necessarily limited thereto, and at least only a part of the plurality of slats 2 needs to be configured by the daylighting slats 4.

The support mechanism 3 has a configuration in which the aforementioned lifting and lowering operation portion 17 and tilting operation portion 18 are operated manually, but may have a configuration in which a lifting and lowering operation of the plurality of slats 2 and a tilting operation of the plurality of slats 2 are operated automatically by using driving means such as a driving motor.

Figure 12A:
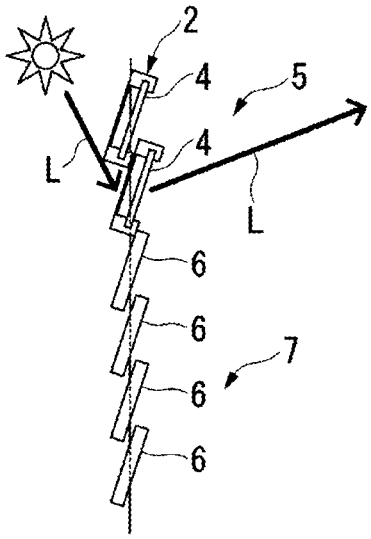
FIG. 12A is a first side view for explaining a tilting operation of the daylighting slats and the light shielding slats.
Figure 12B:
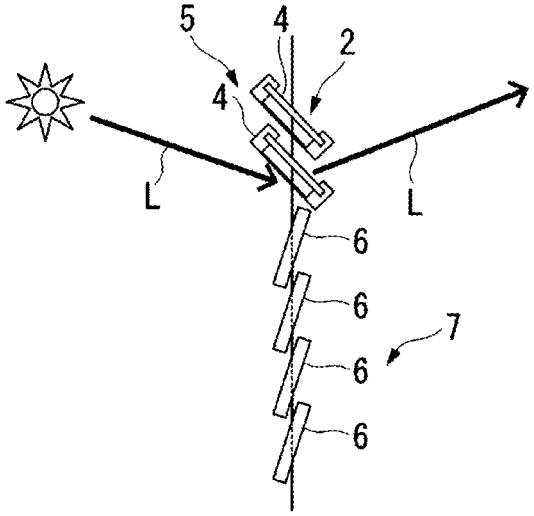
FIG. 12B is a second side view for explaining the tilting operation of the daylighting slats and the light shielding slats.
Figure 12C:
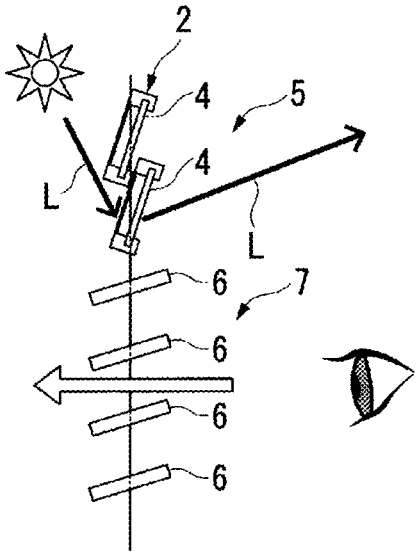
FIG. 12C is a third side view for explaining the tilting operation of the daylighting slats and the light shielding slats.

Further, the support mechanism 3 may be configured to perform operations of tilting the plurality of daylighting slats 4 constituting the daylighting portion 5 and the plurality of light shielding slats 6 constituting the light shielding portion 7 independently, for example, as illustrated in FIG. 12A to FIG. 12C.

Specifically, when the solar altitude is relatively high as illustrated in FIG. 6 and FIG. 12A, by bringing the daylighting portion 5 and the light shielding portion 7 into a closed state, the light L entering the room 1006 through the window glass 1003 is radiated toward the ceiling 1001 of the room 1006 by the plurality of daylighting slats 4 constituting the daylighting portion 5 and the light L traveling to the glare region G is shielded by the plurality of light shielding slats 6 constituting the light shielding portion 7.

On the other hand, when the solar altitude is relatively low as illustrated in FIG. 6 and FIG. 12B, by rotating only the plurality of daylighting slats 4 constituting the daylighting portion 5 accordingly, an angle of each of the daylighting slats 4 is adjusted. This makes it possible to radiate the light L entering the room 1006 through the window glass 1003 toward the ceiling 1001 of the room 1006 by the plurality of daylighting slats 4 constituting the daylighting portion 5 similarly to the case illustrated in FIG. 6 and FIG. 12A.

In addition, by rotating only the plurality of light shielding slats 6 constituting the light shielding portion 7, it is possible to bring the light shielding portion 7 into an opened state with the daylighting portion 5 being in the closed state, as illustrated in FIG. 6 and FIG. 12C. Thereby, it is possible to radiate the light L entering the room 1006 through the window glass 1003 toward the ceiling 1001 of the room 1006 by the plurality of daylighting slats 4 constituting the daylighting portion 5 and to see an outside situation through the window glass 1003 from each space between the plurality of light shielding slats 6 constituting the light shielding portion 7.

Figure 13A:
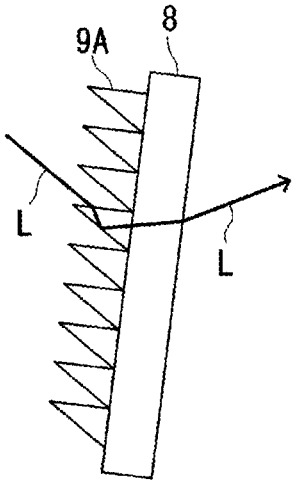
FIG. 13A is a first side view illustrating a modified example of daylighting projections included in the daylighting slat.
Figure 13B:
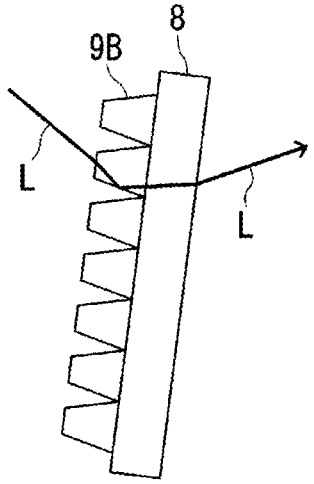
FIG. 13B is a second side view illustrating a modified example of the daylighting projections included in the daylighting slat.
Figure 13C:
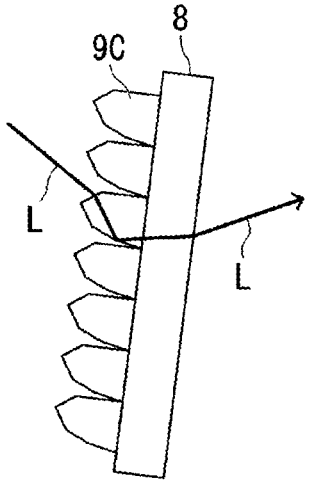
FIG. 13C is a third side view illustrating a modified example of the daylighting projections included in the daylighting slat.

In addition, a cross section of each of the daylighting projections 9 in a direction orthogonal to a longitudinal direction may be formed of a prism with a cross section in a right angled triangle shape, for example, like a daylighting projection 9A illustrated in FIG. 13A, or may be formed of a prism with a cross section in a trapezoid (rectangle) shape like a daylighting projection 9B illustrated in FIG. 13B without limitation to the aforementioned configuration formed of the prism with the triangular cross section, and the shape of the cross section may be changed as appropriate, for example, so as to be a pentagon or a hexagon. FIG. 13C illustrates a daylighting projection 9C whose cross section in the direction orthogonal to the longitudinal direction is in a hexagonal shape.

[Daylighting Slat of Second Embodiment]

Next, a daylighting slat of a second embodiment will be described.

A basic configuration of the daylighting slat of the present embodiment, which will be described below, is approximately similar to that of the aforementioned first embodiment, but, in the present embodiment, different in a configuration of a support member. Thus, in the description below, a configuration of a protective plate will be described in detail, and description for common points will be omitted. In addition, in each figure used for the description, the same reference signs are assigned to components which are common with those in FIG. 1 to FIG. 13C.

Figure 14:
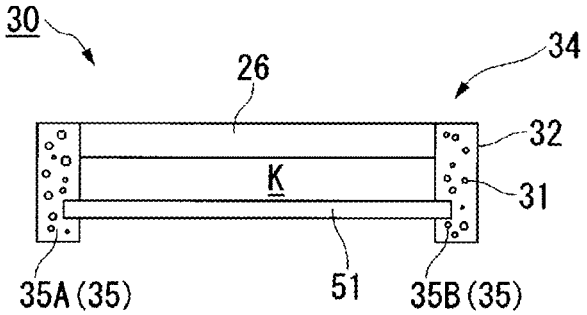
FIG. 14 is a sectional view illustrating a schematic configuration of a daylighting slat of a second embodiment.

FIG. 14 is a sectional view illustrating a schematic configuration of the daylighting slat of the second embodiment.

Though the above-described daylighting slat of the first embodiment has the configuration in which the support member 24 includes the gripping portion 25 having light absorbability, a daylighting slat 30 of the present embodiment has a configuration in which a support member 34 includes a gripping portion 35 having a light diffusing property, as illustrated in FIG. 14.

Each of a first gripping portion 35A and a second gripping portion 35B which constitute the gripping portion 35 is made of a light diffuser which diffuses light output from the daylighting plate 51.

An example of the light diffuser includes one obtained by dispersing fine particles 31 each of which is in a spherical shape having about several tens to several hundreds of micrometers into a resin 32. In addition, a material having a different refractive index from that of the surrounding resin 32 is used for the fine particles 31. This makes it possible to diffuse light with refraction action at an interface between the fine particles 31 and the resin 32. For the fine particles 31, for example, a material made of an inorganic material such as silica (silicon oxide, n (refractive index)=1.46) or titania (titanium oxide, n (refractive index)=2.5 to 2.7), or a material made of an organic material obtained by polymerization of monomers mainly including (meth) acrylic acid ester (n=1.49 to 1.57) and styrene (n=1.6) is able to be used. In addition to these materials, a scatterer having light absorbability or a reflector may be used.

Though only a little, a part of the light output from the daylighting plate 51 is scattered by the gripping portion 35, and thereby the light output from the daylighting plate 51 becomes mellow light, so that it is possible to eliminate glare when being viewed from an inside of a room.

[Daylighting Slat of Third Embodiment]

Next, a daylighting slat of a third embodiment will be described.

A basic configuration of the daylighting slat of the present embodiment, which will be described below, is approximately similar to that of the aforementioned first embodiment, but different in a configuration of a protective plate. Thus, in the description below, the configuration of the protective plate will be described in detail, and description for common points will be omitted. In addition, in each figure used for the description, the same reference signs are assigned to components which are common with those in FIG. 1 to FIG. 13C.

Figure 15:
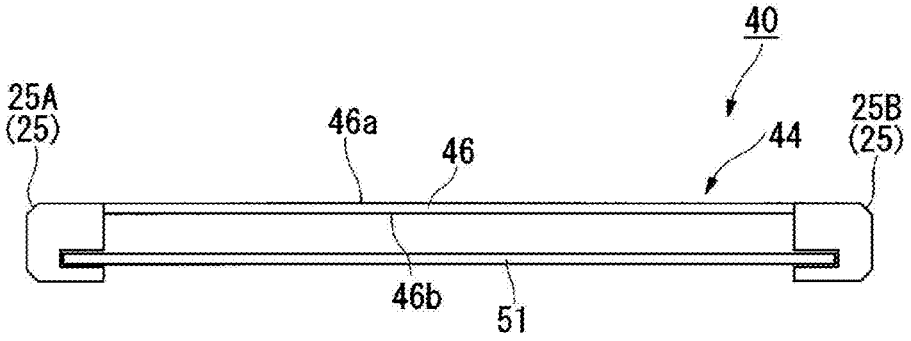
FIG. 15 is a sectional view illustrating a schematic configuration of a daylighting slat of a third embodiment.
Figure 16:
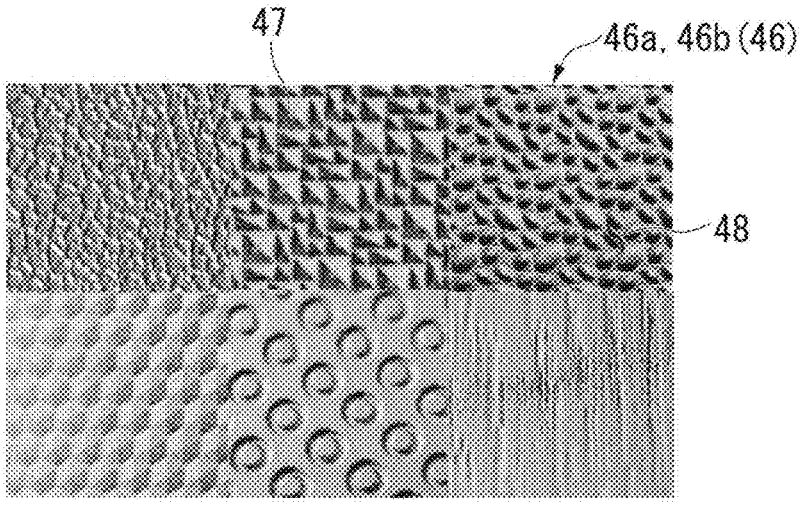
FIG. 16 is a plan view exemplifying a surface shape of a protective plate in the daylighting slat of the third embodiment.

FIG. 15 is a sectional view illustrating a schematic configuration of the daylighting slat of the third embodiment. FIG. 16 is a plan view exemplifying a surface shape of the protective plate in the daylighting slat of the third embodiment.

As illustrated in FIG. 15, a daylighting slat 40 of the present embodiment includes a support member 44 having a protective plate 46 whose one surface side serves as a light diffusing surface 48. Either a front surface 46*a* or a rear surface 46*b* in the protective plate 46 is the light diffusing surface 48 on which fine unevenness 47 (FIG. 16) is formed in a surface direction.

As a manufacturing method of the protective plate 46 having the light diffusing surface 48, at a time of mold or presswork by using plastics or metal, a manufacturing method not by mirror finishing but by emboss processing, in which a die (a cast or a press die) on a surface of which a fine uneven pattern is formed is prepared and the uneven pattern of the die is transferred to a molded article, may be adopted.

Note that, when forming the uneven pattern on a surface of the die, it is possible to form the pattern with chemical treatment by etching or with physical treatment such as sandblasting or polishing treatment not providing mirror finishing.

According to the daylighting slat 40 of the present embodiment, with a configuration in which the protective plate 46 having a light diffusing property is included, light made incident on the daylighting plate 51 and also light traveling to the ceiling 1001 from the daylighting plate 51 are diffused, and it is thereby possible to radiate more uniform light toward the ceiling 1001.

Moreover, by forming the light diffusing surface 48 on one surface side of the protective plate 46 with the emboss processing, it is possible to make appearance luxurious, and achieve an effect of making stain due to a fingerprint or a scratch inconspicuous or the like.

[Daylighting Slat of Fourth Embodiment]

Next, a configuration of a daylighting slat of a fourth embodiment of the invention will be described.

A basic configuration of the daylighting slat of the present embodiment, which will be described below, is approximately similar to that of the aforementioned first embodiment, but different in that a light diffusing film is further included. Thus, in the description below, the light diffusing film and a configuration therearound will be described in detail, and description for common points will be omitted. In addition, in each figure used for the description, the same reference signs are assigned to components which are common with those in FIG. 1 to FIG. 13C.

Figure 17:
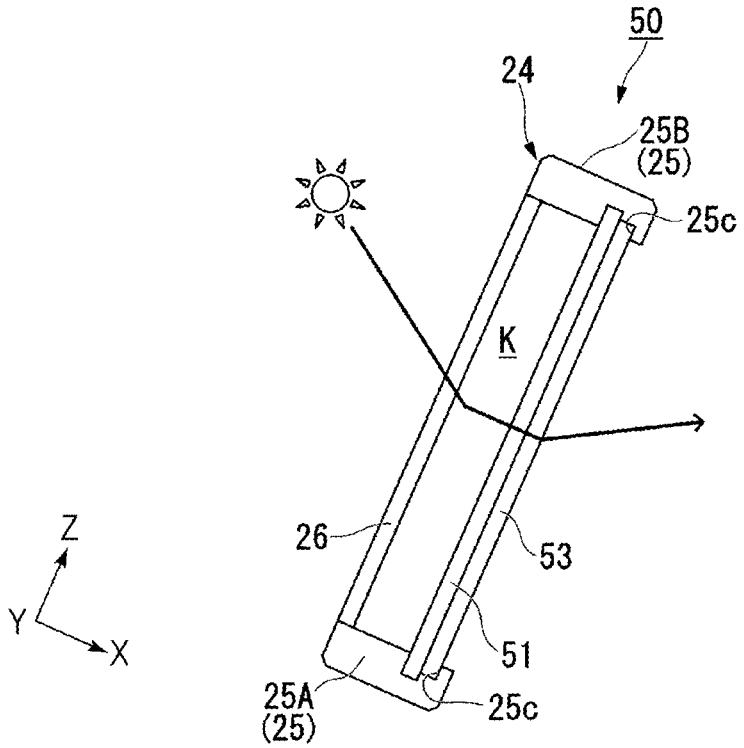
FIG. 17 is a view illustrating a schematic configuration of a daylighting slat of a fourth embodiment.
Figure 18:
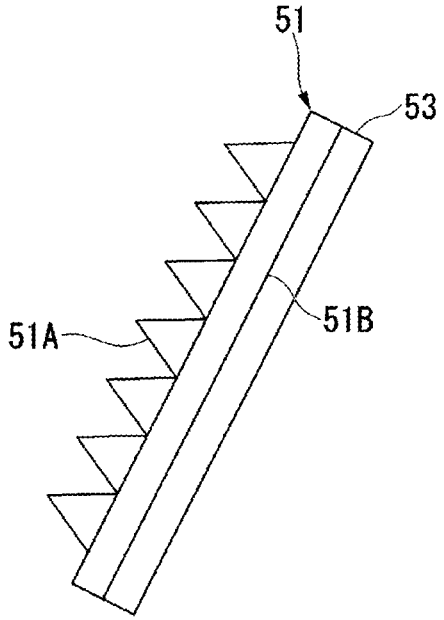
FIG. 18 is a view illustrating an enlarged main part of the daylighting slat of the fourth embodiment.

FIG. 17 is a view illustrating a schematic configuration of the daylighting slat of the fourth embodiment. FIG. 18 is a view illustrating an enlarged main part of the daylighting slat of the fourth embodiment.

A daylighting slat 50 of the present embodiment has a configuration in which the daylighting plate 51 and a light diffusing film (light diffusing layer) 53 are held by the gripping portion 25 of the support member 24 as illustrated in FIG. 17.

The light diffusing film 53 is in a rectangular shape whose shape and size in a plan view are approximately the same as those of the daylighting plate 51 as illustrated in FIG. 17, and provided on a side opposite to the protective plate 26 with the daylighting plate 51 arranged therebetween.

Specifically, the diffusing film 53 is arranged so as to cover a rear surface (surface on a side opposite to the microstructure surface 51A) side of the daylighting plate 51 as illustrated in FIG. 18, and diffuses light output from the daylighting plate 51. It is desired that the light diffusing film 53 has anisotropic scattering performance by which light is scattered mainly in a horizontal direction (longitudinal direction of the daylighting plate 51) and not scattered much in an up-and-down direction (transverse direction of the daylighting plate 51).

The daylighting plate 51 and the light diffusing film 53 are inserted into the pair of grooves 25*c* of the gripping portion 25 so as to be integrated. Here, the daylighting plate 51 and the light diffusing film 53 may be integrated by being bonded together in advance, or may be configured to be integrally held by the gripping portion 25 by being inserted into the grooves 25*c* of the gripping portion 25. A width dimension of each of the grooves 25 is appropriately set in accordance with thicknesses of the daylighting plate 51 and the light diffusing film 53.

Note that, though one light diffusing film 53 is included as the light diffusing layer in the present embodiment, one that has a structure in which a plurality of light diffusing films 53 are laminated may be adopted.

According to the daylighting slat 50 of the present embodiment, by arranging the light diffusing film 53 on a light outputting side of the daylighting plate 51, light traveling to the ceiling 1001 (FIG. 6) from the daylighting plate 51 is diffused by the light diffusing film 53. Thereby, it is possible to radiate more uniform light toward the ceiling 1001 (FIG. 6).

[Daylighting Slat of Fifth Embodiment]

Next, a configuration of a daylighting slat of a fifth embodiment of the invention will be described.

A basic configuration of the daylighting slat of the present embodiment, which will be described below, is approximately similar to that of the aforementioned first embodiment, but different in that a gripping portion includes a plurality of pairs of grooves. Thus, in the description below, a configuration of the gripping portion will be described in detail, and description for common points will be omitted. In addition, in each figure used for the description, the same reference signs are assigned to components which are common with those in FIG. 1 to FIG. 13C.

Figure 19A:
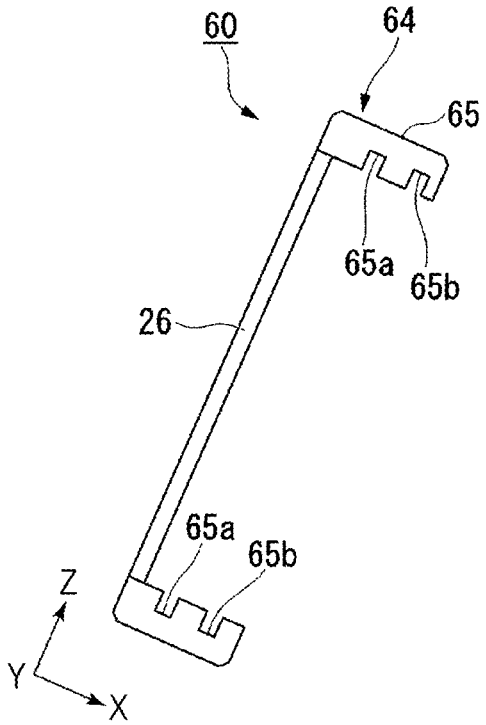
FIG. 19A is a view illustrating a schematic configuration of a daylighting slat of a fifth embodiment, which is a sectional view illustrating only a configuration of a support member.
Figure 19B:
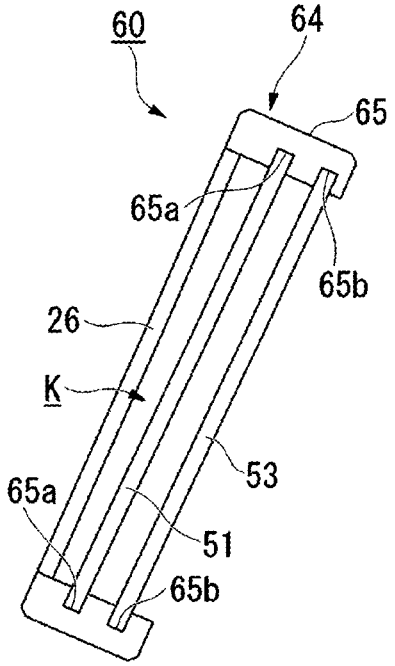
FIG. 19B is a view illustrating the schematic configuration of the daylighting slat of the fifth embodiment, which is a sectional view illustrating a configuration of the daylighting slat.

FIG. 19A and FIG. 19B are views each illustrating a schematic configuration of the daylighting slat of the fifth embodiment, in which FIG. 19A is a sectional view illustrating only a configuration of a support member and FIG. 19B is a sectional view illustrating a configuration of the daylighting slat.

As illustrated in FIG. 19A, a daylighting slat 60 of the present embodiment includes a support member 64 having a gripping portion 65, which has a plurality of pairs of grooves 65*a* and 65*b*, and the protective plate 26. The gripping portion 65 has a pair of first grooves 65*a* and a pair of second grooves 65*b* which are arranged so as to be apart from each other in the X direction and into each of which the daylighting plate 51 or the light diffusing film 53 is inserted (FIG. 19B).

Though a configuration in which the daylighting plate 51 is inserted into the pair of first grooves 65*a* positioned on a side of the protective plate 26 and the light diffusing film 53 is inserted into the second grooves 65*b* which are distant from the protective plate 26 is provided in the present embodiment, there is no limitation thereto. It is possible to appropriately change which of the first grooves 65*a* and the second grooves 65*b* holds which member. That is, a member to be held in addition to the daylighting plate 51 is not limited to the light diffusing film 53, and a daylighting plate which has daylighting performance different from that of the daylighting plate 51 may be held.

[Daylighting Slat of Sixth Embodiment]

Next, a configuration of a daylighting slat of a sixth embodiment of the invention will be described.

A basic configuration of the daylighting slat of the present embodiment, which will be described below, is approximately similar to that of the aforementioned first embodiment, but different in that a support member has a bent shape. Thus, in the description below, the support member and a configuration therearound will be described in detail, and description for common points will be omitted. In addition, in each figure used for the description, the same reference signs are assigned to components which are common with those in FIG. 1 to FIG. 13C.

Figure 20:
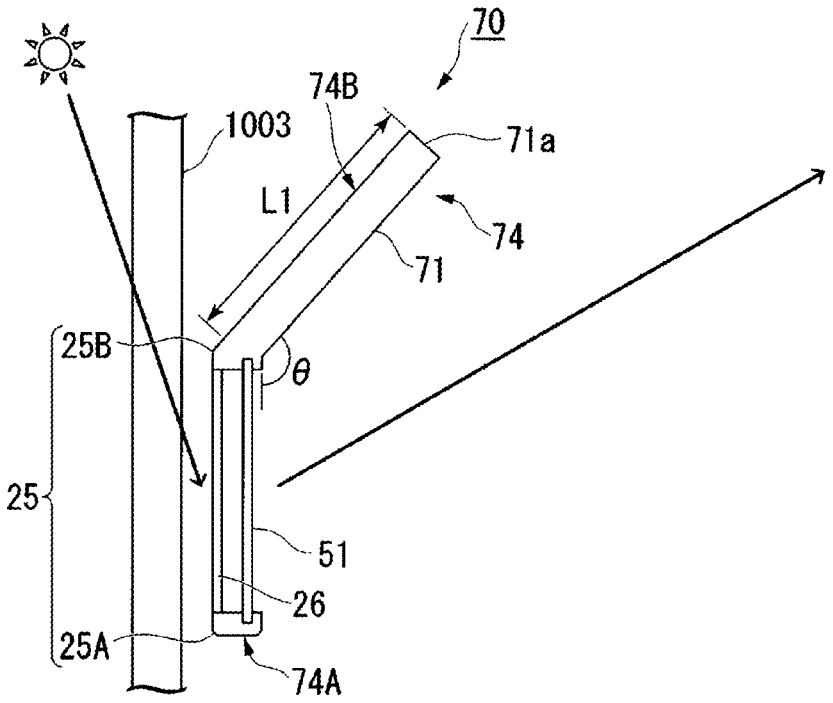
FIG. 20 is a sectional view illustrating a schematic configuration of a daylighting slat of a sixth embodiment.

FIG. 20 is a sectional view illustrating a schematic configuration of the daylighting slat of the sixth embodiment.

As illustrated in FIG. 20, a daylighting slat 70 of the present embodiment has a shape in which a support member 74 supporting the daylighting plate 51 is bent in a middle part in a cross section in a direction orthogonal to a longitudinal direction. The support member 74 includes a first section 74A which supports the daylighting plate 51 and a second section 74B which is not positioned in the same plane as the microstructure surface 51A or a rear surface 51B of the daylighting plate 51.

Specifically, the first section 74A is configured by including the daylighting plate 51, the gripping portion 25 provided with the pair of grooves 25*c* into which the daylighting plate 51 is inserted, and the protective plate 26. The second section 74B includes a light shielding portion 71 which is extended from an upper part of the gripping portion 25. The support member 74 as above is bent in a boundary (the middle part) between the first section 74A and the second section 74B.

The light shielding portion 71 is provided in the second gripping portion 25B on a side which is the upper of the first gripping portion 25A and the second gripping portion 25B which constitute the gripping portion 25. A tip 71*a* of the light shielding portion 71 is tilted to an inside of a room with respect to the protective plate 26 parallel to the window glass 1003. The light shielding portion 71 as above is formed integrally with the second gripping portion 25B by using a material having the same light absorbability as that of the gripping portion 25. An angle θ formed by the gripping portion 25 and the light shielding portion 71 is appropriately set in accordance with a daylighting function of the daylighting plate 51 or the like.

Figure 21A:
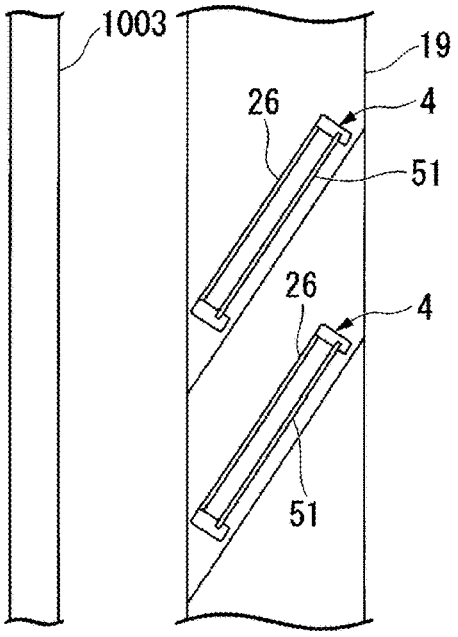
FIG. 21A is a view illustrating a fully closed state of a blind which adopts daylighting slats each having a flat plate shape.
Figure 21B:
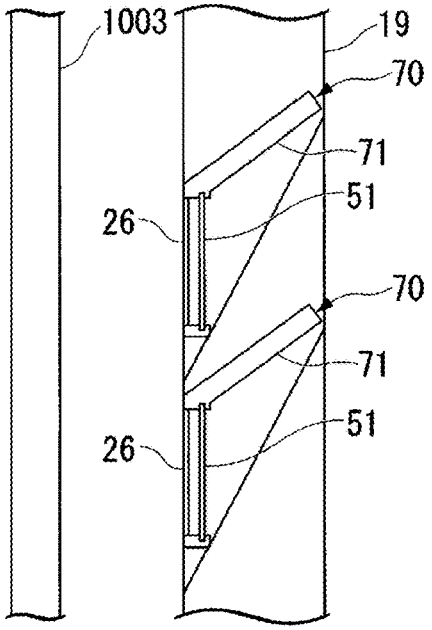
FIG. 21B is a view illustrating a fully closed state of a blind which adopts daylighting slats each having a bent shape.

FIG. 21A is a view illustrating a fully closed state of a blind which adopts daylighting slats each having a flat plate shape. FIG. 21B is a view illustrating a fully closed state of a blind which adopts daylighting slats each having a bent shape.

As illustrated in FIG. 21A, in the case of the blind which adopts the daylighting slats each having the flat plate shape, the daylighting slats 4 (daylighting plates 51) are not parallel to the window glass 1003 in the fully closed state, and are in a tilted state. That is, because of a structure in which end parts of the daylighting slats arrayed in a vertical direction in a plan view overlap with each other and thereby light leakage to an inside of a room is prevented, even when trying to make each of the daylighting slats 4 have a standing posture by operating the lifting and lowering cords 19 illustrated in FIG. 1, the end parts of the daylighting slats 4 arrayed in the vertical direction are in contact with each other, so that each of the daylighting slats 4 does not have a vertical posture.

On the other hand, as illustrated in FIG. 21B, in the case of the blind which adopts the daylighting slats 70 each having the bent shape, in the fully closed state, a part (daylighting plate 51) of each of the daylighting slats 70 arrayed in the vertical direction has a posture parallel to the window glass 1003. The light shielding portion 71 provided in each of the daylighting slats 70 is configured to prevent light leakage resulting from a gap between the daylighting slats 70 arrayed in the vertical direction in a plan view. Thus, as illustrated in FIG. 20, not only the daylighting function of the daylighting plate 51 but also an arrangement interval between the daylighting slats 70 arrayed in the vertical direction and the like are taken into consideration for the angle θ formed by the light shielding portion 71 and the gripping portion 25 and an extended length L1 of the light shielding portion 71.

[Daylighting Slat of Seventh Embodiment]

Next, a configuration of a daylighting slat of a seventh embodiment of the invention will be described.

The daylighting slat of the present embodiment, which will be described below, is different from the aforementioned embodiments in that a pair of daylighting plates which have different daylighting functions is included. In the description below, description for points common with those of the aforementioned embodiments will be omitted, and, in each figure used for the description, the same reference signs are assigned to components which are common with those in FIG. 1 to FIG. 14.

Figure 22:
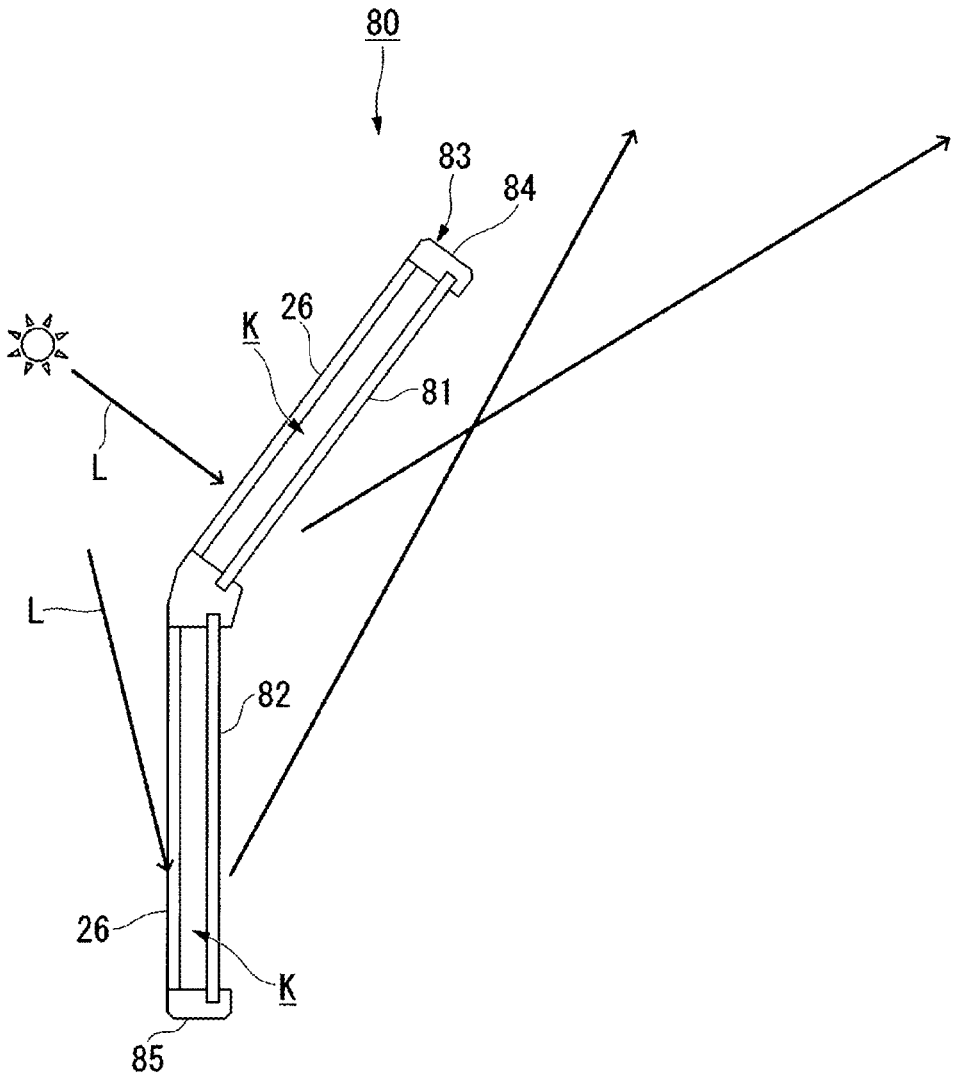
FIG. 22 is a sectional view illustrating a schematic configuration of a daylighting slat of a seventh embodiment.
Figure 23:
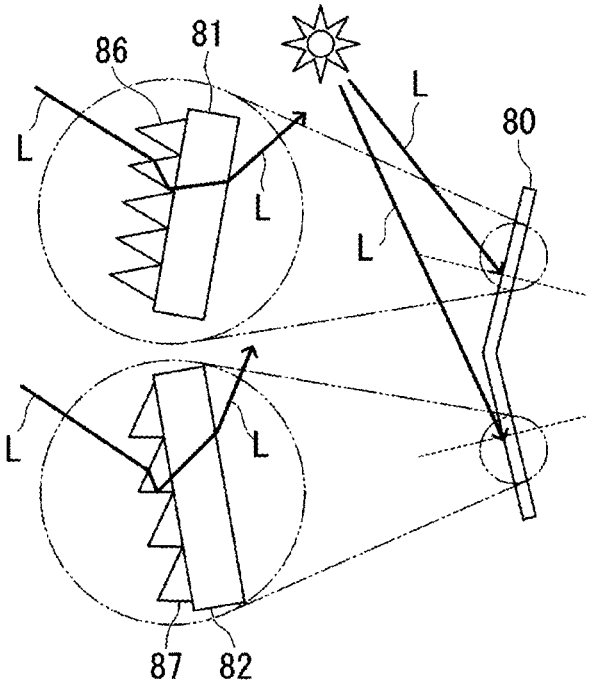
FIG. 23 is a sectional view illustrating an enlarged main part of the daylighting slat of the seventh embodiment.

FIG. 22 is a sectional view illustrating a schematic configuration of the daylighting slat of the seventh embodiment. FIG. 23 is a sectional view illustrating an enlarged main part of the daylighting slat of the seventh embodiment.

As illustrated in FIG. 22, a daylighting slat 80 of the present embodiment includes a first daylighting plate (first daylighting slat) 81 and a second daylighting plate (second daylighting slat) 82, which have mutually different daylighting functions, and a support member 83 which supports the first daylighting plate 81 and the second daylighting plate 82. The daylighting slat 80 has a shape bending in a middle part of the support member 83 in a cross section in a direction orthogonal to a longitudinal direction.

The support member 83 includes a gripping portion 84 which grips the first daylighting plate 81, a gripping portion 85 which grips the second daylighting plate 82, and two protective plates 26 which protect microstructures of the first daylighting plate 81 and the second daylighting plate 82.

One protective plate 26 is arranged via the gripping portion 84, which is positioned in an upper part of the support member 83, so as to face the first daylighting plate 81, and the other protective plate 26 is arranged via the gripping portion 85, which is positioned in a lower part of the support member 83, so as to face the second daylighting plate 82.

Between a plurality of first daylighting projections 86 provided in the first daylighting plate 81 and a plurality of second daylighting projections 87 provided in the second daylighting plate 82, shapes in respective cross sections are different as illustrated in FIG. 23. Each of the first daylighting projections 86 is formed of a prism having an angle at which light made incident on the daylighting slat 80 (first daylighting plate 81) is output toward the ceiling 1001 deep inside the room 1006. On the other hand, each of the second daylighting projections 87 is formed of a prism having an angle at which light made incident on the daylighting slat 80 (second daylighting plate 82) is output toward the ceiling 1001 close to a window of the room 1006.

In the case of this configuration, the light L entering the daylighting slat 80 is output by the first daylighting projections 86 and the second daylighting projections 87 at mutually different angles, and respectively radiated to the ceiling 1001 from a window side to the deep inside of the room 1006. Thus, it is possible to radiate light to almost the whole of the ceiling 1001 of the room 1006 regardless of the solar altitude. In addition, since the daylighting slat 80 of the present embodiment has the bent shape, it is possible to continuously change angles at which entering light is output toward the ceiling 1001 of the room 1006. This makes it possible to radiate more uniform light L toward the ceiling 1001.

[Daylighting Slat of Eighth Embodiment]

Next, a daylighting slat of an eighth embodiment will be described.

A basic configuration of the daylighting slat of the present embodiment, which will be described below, is approximately similar to that of the aforementioned first embodiment, but different in that a thickness of a protective plate is not constant. Thus, in the description below, a configuration of the protective plate will be described in detail, and description for common points will be omitted. In addition, in each figure used for the description, the same reference signs are assigned to components which are common with those in FIG. 1 to FIG. 13C.

Figure 24:
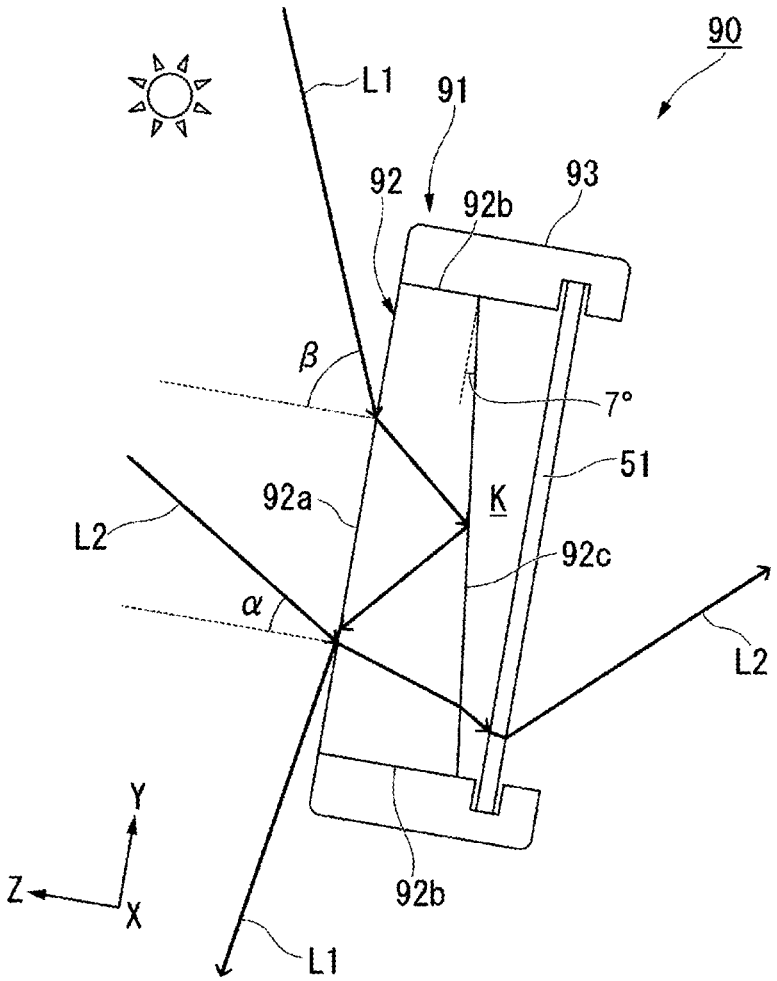
FIG. 24 is a sectional view illustrating a schematic configuration of a daylighting slat of an eighth embodiment.

FIG. 24 is a sectional view illustrating a schematic configuration of the daylighting slat of the eighth embodiment.

As illustrated in FIG. 24, a daylighting slat 90 has a configuration in which a support member 91 includes a protective plate 92 thickness of which varies in a width direction (transverse direction) and a gripping portion 93. A cross section of the protective plate 92 in a direction orthogonal to a longitudinal direction is in a trapezoid shape, and a rear surface 92*c* is inclined at about 7° with respect to a front surface 92*a*. That is, a plate thickness of the protective plate 92 increases as, from one side surface 92*b*, being close to the other side surface 92*b*.

In this configuration, in a case where incident light L1 from the sun is made incident on the daylighting slat 90 at an incident angle β which is not less than 60°, the incident light L1 is totally reflected by the rear surface 92*c* of the protective plate 92 and output to an outside of the room again. On the other hand, in a case where incident light L2 is made incident on the daylighting slat 90 at an incident angle α which is less than 60°, the incident light L2 enters the room 1006 without being totally reflected by the rear surface 92*c* of the protective plate 92.

With the daylighting slat 90 of the present embodiment, it is possible to take sunlight for use as lighting or solar radiation heat in the winter season when the solar altitude becomes low. In addition, in the summer season when the solar altitude is high, from a viewpoint of energy saving or comfort in the room 1006, it is possible to shield the sunlight or block heat thereof instead of taking the sunlight to cause it to enter the room. As above, the daylighting slat 90 exhibits a function corresponding to the season.

[Daylighting Slat of Ninth Embodiment]

Next, a configuration of a daylighting slat of a ninth embodiment of the invention will be described.

A basic configuration of the daylighting slat of the present embodiment, which will be described below, is approximately similar to that of the aforementioned first embodiment, but different in that a support member has a bent shape. Thus, in the description below, the support member and a configuration therearound will be described in detail, and description for common points will be omitted.

In addition, in each figure used for the description, the same reference signs are assigned to components which are common with those in FIG. 1 to FIG. 13C.

Figure 25:
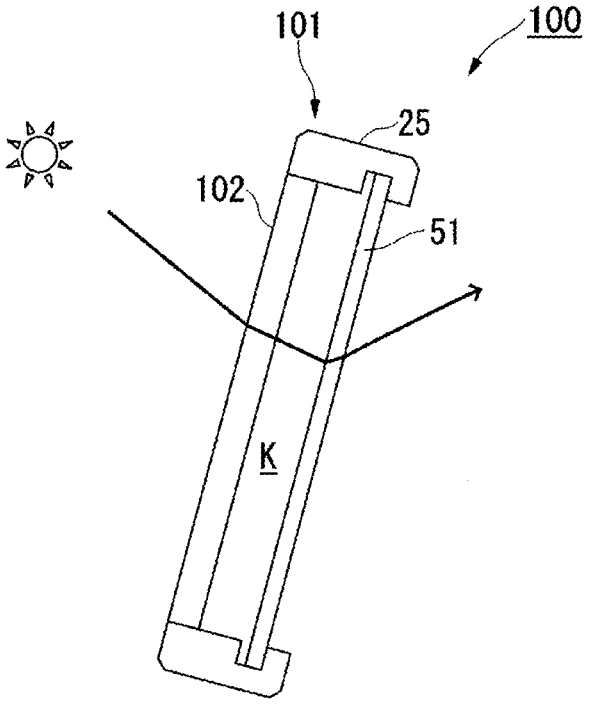
FIG. 25 is a sectional view illustrating a schematic configuration of a daylighting slat of a ninth embodiment.

FIG. 25 is a sectional view illustrating a schematic configuration of the daylighting slat of the ninth embodiment.

As illustrated in FIG. 25, a daylighting slat 100 is configured by including the daylighting plate 51 and a support member 101 which supports the daylighting plate 51, and a light transmitting part of the support member 101 has ultraviolet absorbability.

The support member 101 has the gripping portion 25 which grips the daylighting plate 51 and a protective plate 102 which faces the daylighting plate 51 inserted into the groove 25*c* of the gripping portion 25. The protective plate 102 has ultraviolet absorbability, and formed of a transparent member to which an ultraviolet absorber is added.

In some cases, a color of the daylighting plate 51 which is formed by using a transparent resin material changes due to a phenomenon such that a molecular bond is broken by ultraviolet rays. Therefore, by applying ultraviolet absorbability to the protective plate 102 which exists on a light entering side of the daylighting plate, it is possible to prevent the color of the daylighting plate 51 from changing (yellowing). Note that, also in the protective plate 102 which is formed by using a transparent resin material as well, by being formed of a material to which an ultraviolet absorber is added, it is possible to prevent a color of the protective plate 102 itself from changing.

Though the configuration in which the protective plate 102 having ultraviolet absorbability is included as a countermeasure against ultraviolet rays to the daylighting plate 51 is provided in the present embodiment, there is no limitation thereto. For example, not ultraviolet absorbability but an ultraviolet reflecting property may be given to the support member 101.

Figure 26:
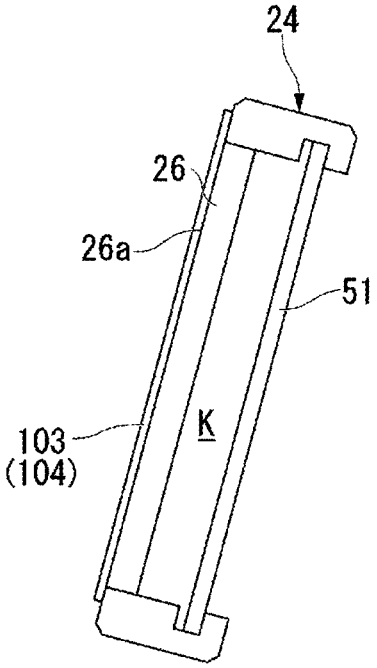
FIG. 26 is a sectional view illustrating a configuration of a daylighting slat which is provided with an ultraviolet reflecting layer.

Moreover, a configuration in which an ultraviolet absorbing layer 103 or an ultraviolet reflecting layer 104 is provided on the front surface 26*a* of the protective plate 26 which is formed only of a transparent resin material may be provided as illustrated in FIG. 26.

In addition, a configuration in which an infrared reflecting property is given to the protective plate 26 or an infrared reflecting layer is separately included may be provided. Thereby, it is possible to avoid taking near infrared rays, which cause heat in the summer season, into a room, so that comfort in the room in the summer season is improved.

Furthermore, a support member to which both of ultraviolet absorbability and an infrared reflecting property are added may be provided.

Figure 27A:
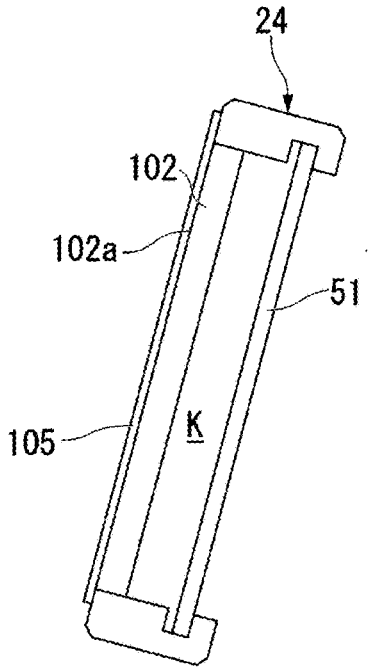
FIG. 27A is a view illustrating a configuration in which an infrared reflecting layer is provided.
Figure 27B:
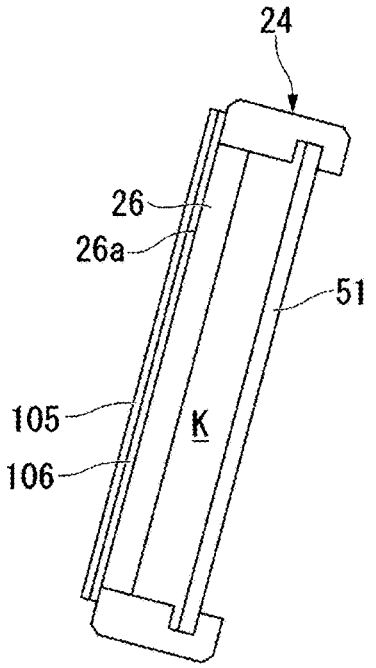
FIG. 27B is a view illustrating a configuration in which an ultraviolet incidence preventing layer and the infrared reflecting layer are provided.

For example, an infrared reflecting layer 105 may be provided on a front surface 102*a* of the protective plate 102, to which ultraviolet absorbability is given, as illustrated in FIG. 27A. Alternatively, an ultraviolet incidence preventing layer 106 and the infrared reflecting layer 105 may be laminated onto the front surface 26*a* of the protective plate 26, which is formed of the transparent resin material, as illustrated in FIG. 27B.

[Modified Examples of Daylighting Device]

Next, modified examples of the daylighting device of the invention will be described.

A basic configuration of a daylighting device of the present embodiment, which will be described below, is approximately similar to that of the aforementioned first embodiment, but different in that at least a part of a light shielding portion of a blind is constituted by a colored slat which is colored and has light transparency. Thus, in the description below, a configuration of the colored slat will be described in detail, and description for common points will be omitted.

In addition, in each figure used for the description, the same reference signs are assigned to components which are common with those in FIG. 1 to FIG. 13C.

Figure 28A:
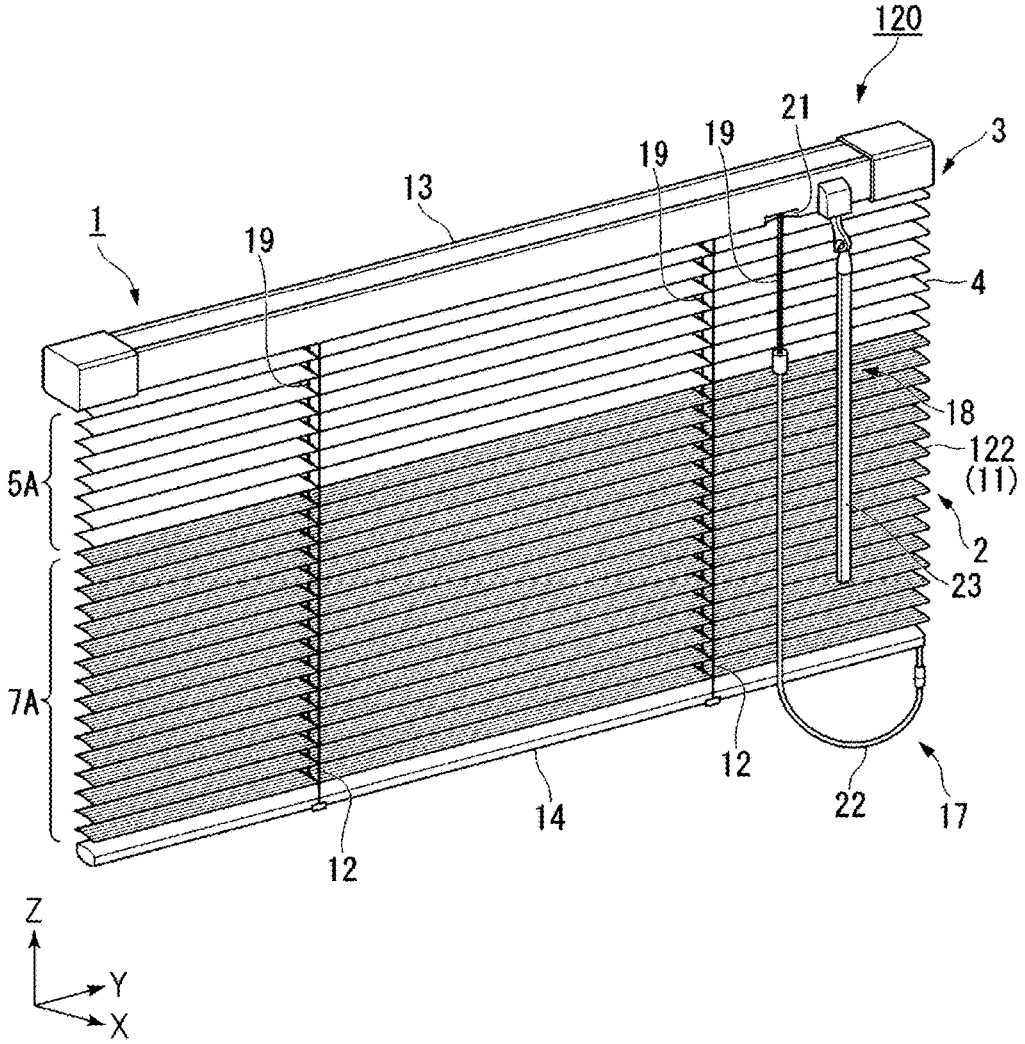
FIG. 28A is a view illustrating a modified example of the daylighting device.
Figure 28B:
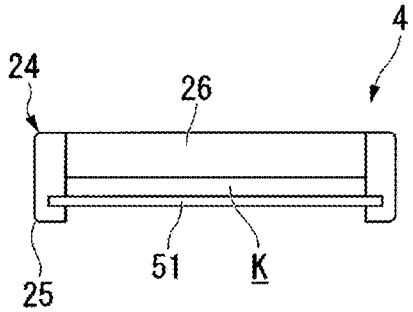
FIG. 28B is a view illustrating a schematic configuration of a daylighting slat.
Figure 28C:
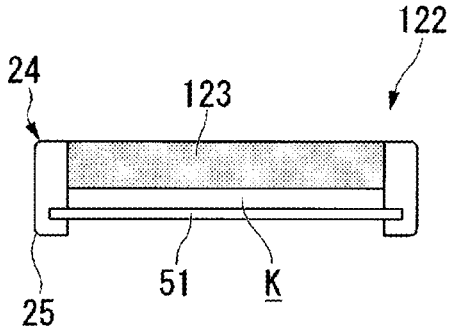
FIG. 28C is a view illustrating a schematic configuration of a colored slat.

FIG. 28A is a view illustrating a modified example of the daylighting device, FIG. 28B is a view illustrating a schematic configuration of a daylighting slat, and FIG. 28C is a view illustrating a schematic configuration of the colored slat.

As illustrated in FIG. 28A and FIG. 28B, a daylighting device 120 includes a plurality of daylighting slats 4 which constitute a first daylighting portion 5A and a plurality of colored slats 122 which constitute a second daylighting portion 7A.

Though a basic configuration of each of the colored slats 122 is approximately similar to that of each of the daylighting slats 4, which is illustrated in FIG. 28B, a protective plate 123 of the colored slat 122 illustrated in FIG. 28C is formed by using a member which is colored in a predetermined color and has light transparency, while the protective plate 26 of the daylighting slat 4 is formed of a transparent member. That is, the protective plate 123 of the colored slat 122 has a characteristic that a light transmittance thereof is lower than that of the protective plate 26 of the daylighting slat 4.

The second daylighting portion 7A in a lower part of the daylighting device 120 is constituted by the colored slats 122 each of which has the light transmittance lower than that of each of the daylighting slats 4 which constitute the first daylighting portion 5A in an upper part, so that it is possible to improve brightness in a room compared with a slat which completely shields external light. Moreover, excessive glare light does not enter eyes of a person in the room or a monitor of a personal computer, so that it is possible to obtain a comfortable indoor environment. Furthermore, there is no risk of peeping into the room from an outside of the room, and privacy of the person in the room is therefore secured.

Note that, among the plurality of slats 2 constituting the second daylighting portion 7A, all of the slats may be the colored slats 122, or the colored slats 122 may be adopted for a part and the above-described light shielding slats 6 may be adopted for the rest. Moreover, the daylighting slat of one of the above-described embodiments may be adopted instead of the daylighting slat 4.

As above, although the description has been given for suitable embodiments according to the invention with reference to the attached drawings, it is needless to say that the invention is not limited to relating examples. It is obvious that persons skilled in the art can arrive at various changed examples or modified examples within the scope of technical idea described in the claims, and it will be understood that they naturally belong to the technical scope of the invention. The configurations of the respective embodiments may be combined as appropriate.

In each of the aforementioned embodiments, the plurality of daylighting slats are arranged with a side of the protective plates facing a side of the window glass 1003, but the daylighting slats may be installed with the side of the protective plates facing an inside of a room.

Figure 29A:
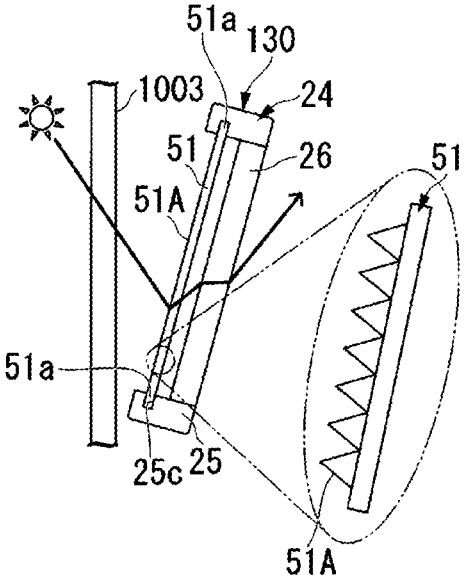
FIG. 29A is a first view illustrating another configuration of a daylighting slat.

For example, a configuration in which the daylighting plate 51 is inserted into the groove 25*c* of the gripping portion 25 in a posture that the microstructure surface 51A thereof faces a side opposite to the protective plate 26 (side of the window glass 1003) may be provided as a daylighting slat 130 illustrated in FIG. 29A.

It is possible to efficiently take external light and output light toward a ceiling in a room also with such a configuration.

Moreover, although the configuration in which the side parts 51*a* and 51*a* on the both sides in the transverse direction of the daylighting plate 51 are supported is provided in each of the aforementioned embodiments, a configuration in which side parts on both sides in a longitudinal direction are supported may be provided, or a configuration in which the whole of a peripheral part of the daylighting plate 51 is supported may be provided.

Figure 29B:
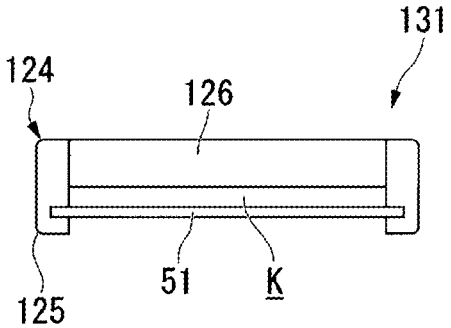
FIG. 29B is a second view illustrating still another configuration of a daylighting slat.

In addition, as a daylighting slat 131 illustrated in FIG. 29B, a gripping portion 125 and a protective plate 126 which constitute a support member 124 may be formed of a transparent member having light transparency. In this case, examples of a material of the gripping portion 125 include a transparent elastomer resin, and examples of a material of the protective plate 126 include transparent plastic, glass, and the like.

Here, examples of the materials of the gripping portion 125 and the protective plate 126 are shown in a table 1.

TABLE 1

| Constituent | Material Material quality | ρ Density [g/cm$^3$] | E Young's modulus [MPa] | E/ρ Young's modulus/relative density |
|---|---|---|---|---|
| Protective plate | Glass | 2.51 | 77000 | 30677.3 |
| | Acrylic resin | 1.19 | 3200 | 2689.1 |
| Gripping portion | Transparent elastomer | 1.11 | 33.6 | 30.3 |

As shown in the table 1, the transparent elastomer resin used for the gripping portion 125 has flexibility, and is therefore preferable for holding the daylighting plate 51. However, since Young's modulus thereof is low compared with that of an acrylic resin, which has similar density, or the like, the support member 124 is easily bent when the whole thereof is formed of the transparent elastomer resin. Accordingly, it is preferable to form the protective plate 126 by using the acrylic resin which has approximately the same density as that of the transparent elastomer resin or glass both of density and Young's modulus of which are high. Thereby, it is possible to form the support member 124 which suppresses bending and with which the daylighting plate 51 is easily gripped.

Figure 29C:
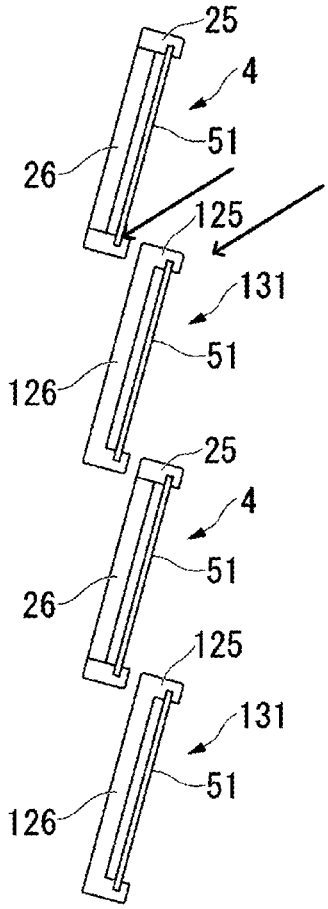
FIG. 29C is a view illustrating a main part of a daylighting device in which designability is provided.

It is considered that, in a case where the gripping portion 125 has light transparency, efficiency of guiding sunlight into a room is enhanced. In addition, a configuration in which the daylighting slats 4 the gripping portion 25 of each of which has a light shielding property and daylighting slats 131 the gripping portion 125 of each of which has light transparency are arranged alternately may be provided as illustrated in FIG. 29C. Thereby, it is possible to give designability to the daylighting device while suppressing stray light.

Note that, the whole of the gripping portion 125 may have light transparency, or at least a part thereof may have light transparency.

[Lighting Control System]

Figure 30:
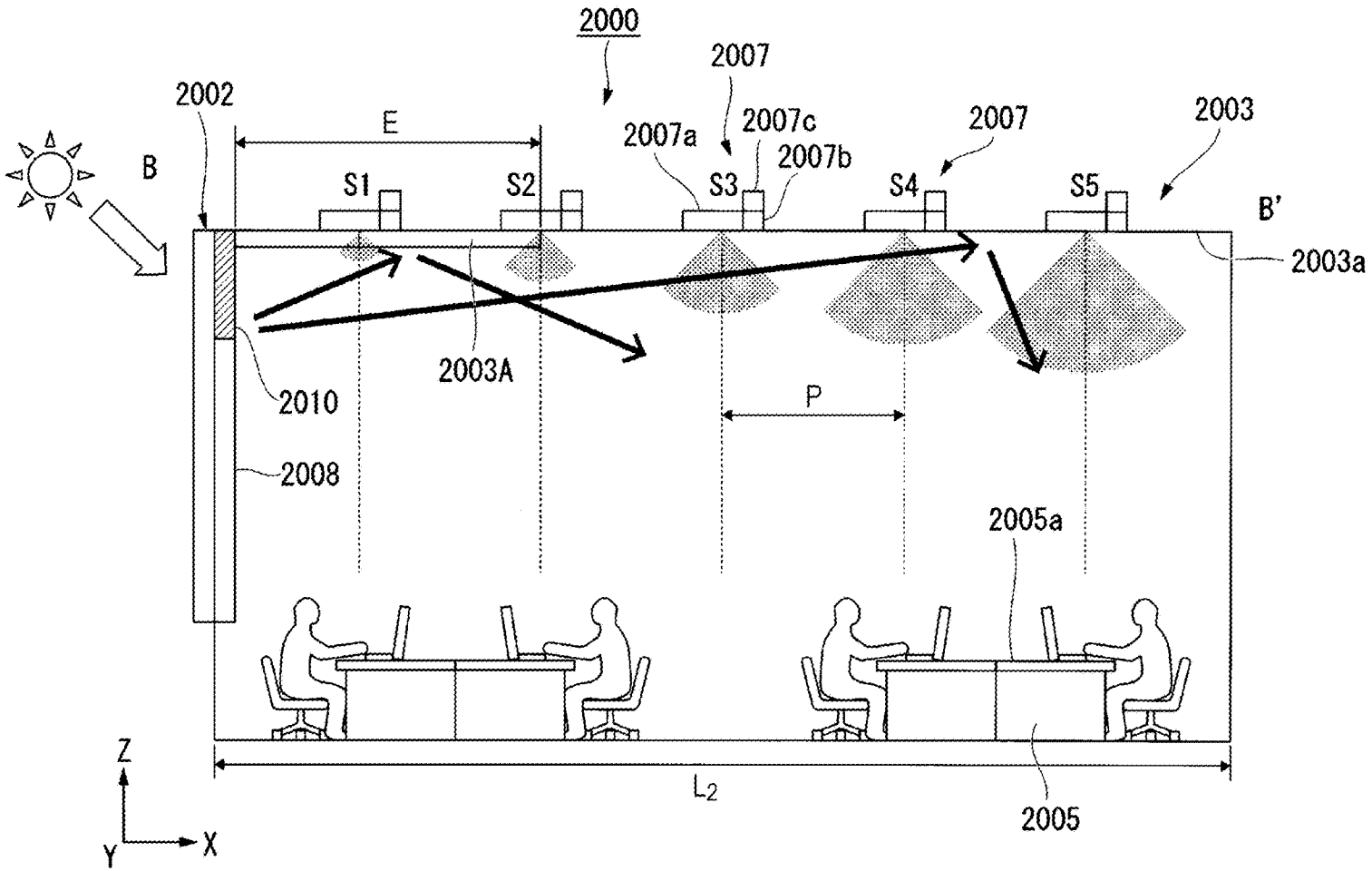
FIG. 30 is a view illustrating a room model in which a daylighting device and a lighting control system are included, which is a sectional view taken along a B-B' line of FIG. 31.
Figure 31:
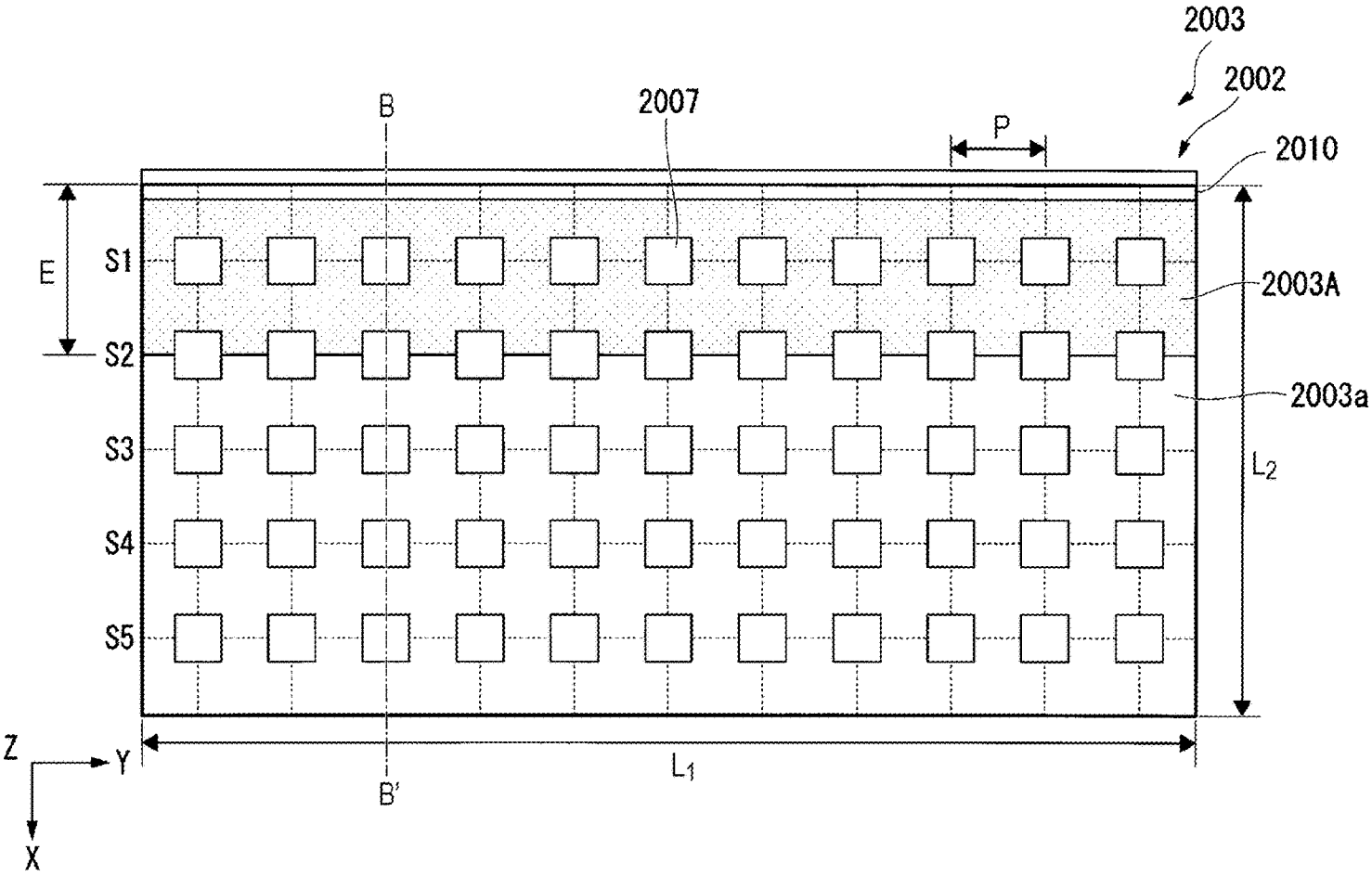
FIG. 31 is a plan view illustrating a ceiling of the room model.

FIG. 30 illustrates a room model 2000, in which a daylighting device and a lighting control system are included, and is a sectional view taken along a B-B' line of FIG. 31. FIG. 31 is a plan view illustrating a ceiling of the room model 2000.

In the room model 2000, a ceiling material constituting a ceiling 2003*a* of a room 2003 to which external light is guided may have high light reflectivity. As illustrated in FIG. 30 and FIG. 31, a light reflective ceiling material 2003A is installed on the ceiling 2003*a* of the room 2003 as the ceiling material having light reflectivity. In order to promote guiding of external light from a daylighting device 2010 installed on a window 2002 to the deep inside of the room, the light reflective ceiling material 2003A is installed on the ceiling 2003*a* on a window side. Specifically, the light reflective ceiling material 2003A is installed in a predetermined region E (a region of about 3 m from the window 2002) of the ceiling 2003*a*.

As described above, the light reflective ceiling material 2003A functions to guide the external light, which is guided into the room through the window 2002 on which the daylighting device 2010 (the daylighting device of any of the aforementioned embodiments) is installed, to the deep inside of the room efficiently. The external light guided from the daylighting device 2010 toward the ceiling 2003*a* in the room is reflected by the light reflective ceiling material 2003A and has a direction changed to illuminate a desk top surface 2005*a* of a desk 2005 which is placed in the deep inside of the room, thus exerting an effect of making the desk top surface 2005*a* bright.

The light reflective ceiling material 2003A may have diffusion reflectivity or may have specular reflectivity, but preferably has both properties mixed moderately in order to achieve both of an effect of making the desk top surface 2005*a* of the desk 2005 placed in the deep inside of the room bright and an effect of suppressing glare light uncomfortable for a person in the room.

Though most of the light guided into the room by the daylighting device 2010 travels to the ceiling near the window 2002, a sufficient light amount is provided near the window 2002 in many cases. Thus, by using the light reflective ceiling material 2003A as described above in combination, it is possible to allocate the light incident on the ceiling (region E) near the window to the deep inside of the room that has a less light amount compared with the window side.

The light reflective ceiling material 2003A is able to be created, for example, by embossing a metal plate made of aluminum or the like with unevenness of about several tens of microns or by applying vapor deposition of a metal thin film made of aluminum or the like to a surface of a resin base on which similar unevenness is formed. Alternatively, unevenness formed by embossing may be formed on a curved surface with a greater cycle.

Further, by appropriately changing an embossing shape to be formed on the light reflective ceiling material 2003A, it is possible to control light distribution characteristics of light and distribution of light in the room. For example, when the embossment is performed in a stripe shape extending to the deep inside of the room, the light reflected by the light reflective ceiling material 2003A expands in a right-and-left direction of the window 2002 (a direction intersecting a longitudinal direction of unevenness). When a size or a direction of the window 2002 of the room 2003 is limited, by using such a property, it is possible to diffuse the light in a horizontal direction and reflect it to the deep inside of the room by the light reflective ceiling material 2003A.

The daylighting device 2010 is used as a part of a lighting control system of the room 2003. The lighting control system includes components of the entire room, for example, the daylighting device 2010, a plurality of indoor lighting devices 2007, a solar radiation adjustment device 2008 installed on the window, a control system thereof, and the light reflective ceiling material 2003A installed on the ceiling 2003*a*.

The window 2002 of the room 2003 has the daylighting device 2010 installed on an upper side thereof and has the solar radiation adjustment device 2008 installed on a lower side thereof. Here, a blind is installed as the solar radiation adjustment device 2008, but there is no limitation thereto.

In the room 2003, the plurality of indoor lighting devices 2007 are arranged in a lattice manner in the right-and-left direction of the window 2002 (Y direction) and in a depth direction of the room (X direction). The plurality of indoor lighting devices 2007 constitute the entire lighting system of the room 2003 with the daylighting device 2010.

As illustrated in FIG. 30 and FIG. 31, for example, the ceiling 2003*a* of an office in which a length $L_1$ of the window 2002 in the right-and-left direction (Y direction) is 18 m and a length $L_2$ of the room 2003 in the depth direction (X direction) is 9 m is illustrated. Here, the indoor lighting devices 2007 are arranged in a lattice manner at each interval P of 1.8 m in a lateral direction (Y direction) and a depth direction (X direction) of the ceiling 2003*a*.

More specifically, fifty indoor lighting devices 2007 are arrayed in 10 rows (Y direction)×5 columns (X direction).

Each of the indoor lighting devices 2007 includes indoor lighting equipment 2007*a*, a brightness detection portion 2007*b*, and a control portion 2007*c*, and is formed with the brightness detection portion 2007*b* and the control portion 2007*c* integrated with the indoor lighting equipment 2007*a*.

Each of the indoor lighting devices 2007 may include a plurality of pieces of indoor lighting equipment 2007*a* and a plurality of brightness detection portions 2007*b*. However, one brightness detection portion 2007*b* is provided for each one piece of indoor lighting equipment 2007*a*. The brightness detection portion 2007*b* receives reflection light by an irradiated surface illuminated by the indoor lighting equipment 2007*a* and detects illuminance of the irradiated surface. Here, the illuminance of the desk top surface 2005*a* of the desk 2005 placed in the room is detected by the brightness detection portion 200*b*.

The control portions 2007*c* each one of which is provided in each of the indoor lighting devices 2007 are connected to each other. Each of the indoor lighting devices 2007 performs feedback control, by the control portions 2007*c* connected to each other, to adjust light outputs of LED lamps of each indoor lighting equipment 2007*a* so that the illuminance of the desk top surface 2005*a* that is detected by each brightness detection portion 2007*b* becomes a fixed target illuminance L0 (for example, average illuminance: 750 lx).

Figure 32:
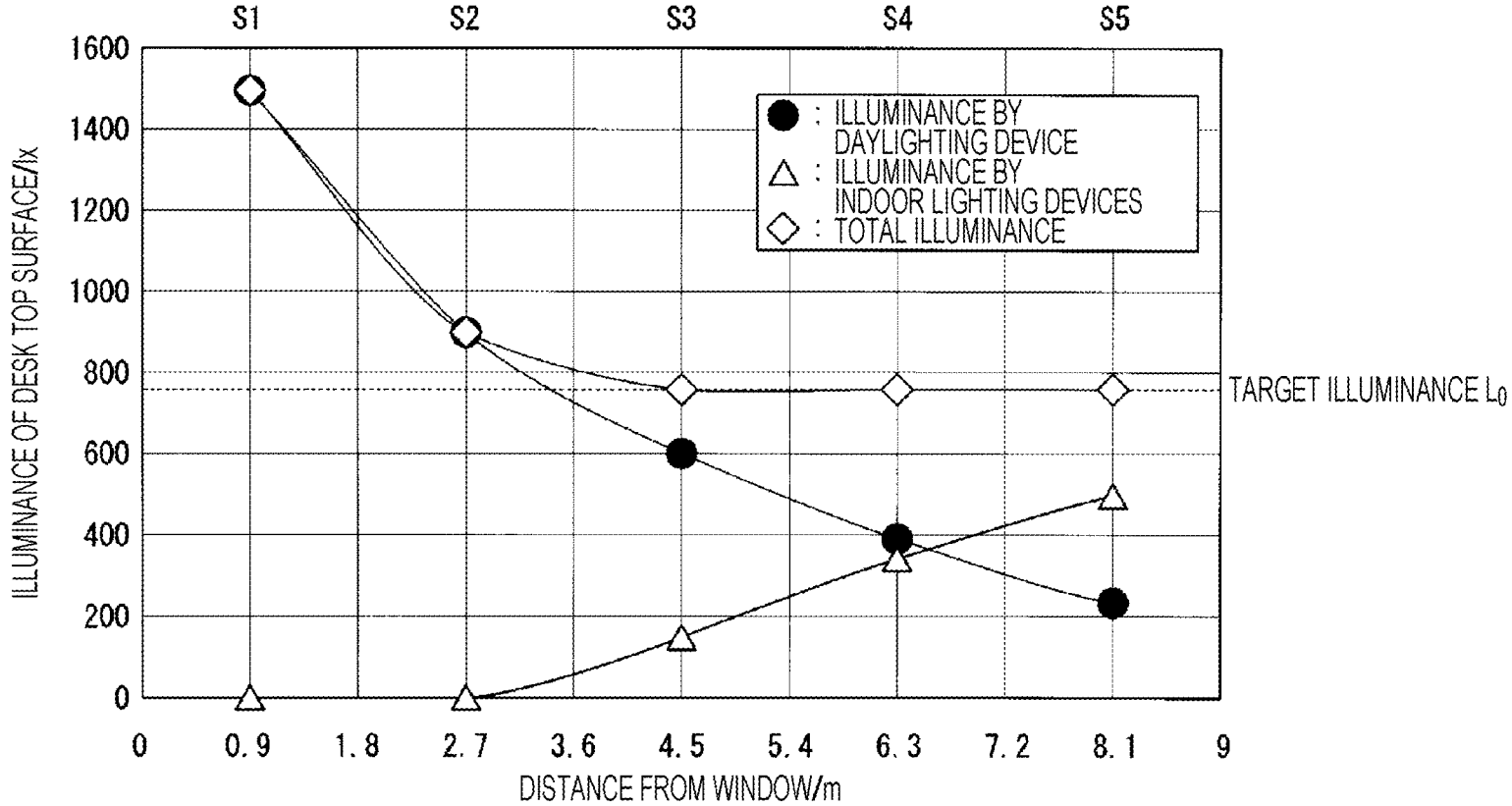
FIG. 32 is a graph indicating a relation between illuminance of light (natural light) taken into a room by the daylighting device and illuminance by an indoor lighting devices (lighting control system).

FIG. 32 is a graph indicating a relation between illuminance of light (natural light) taken into the room by the daylighting device and illuminance by the indoor lighting devices (lighting control system). In FIG. 32, a vertical axis indicates the illuminance (lx) of the desk top surface, and a horizontal axis indicates a distance (m) from the window. Moreover, a broken line in the figure indicates the target illuminance in the room. (●: illuminance by the daylighting device, Δ: illuminance by the indoor lighting devices, and ◇: total illuminance)

As illustrated in FIG. 32, the illuminance of the desk top surface resulting from light taken by the daylighting device 2010 is brighter as being close to the window, and an effect thereof is reduced as being away from the window. In the room to which the daylighting device 2010 is applied, such illuminance distribution in the depth direction of the room is generated due to natural lighting from the window in the daytime. Then, the daylighting device 2010 is used in combination with the indoor lighting devices 2007 which compensate the illuminance distribution in the room. Each of the indoor lighting devices 2007 installed on the ceiling in the room detects average illuminance under the device by the brightness detection portion 2007*b*, and is turned on by being subjected to lighting control so that illuminance of all desk top surfaces in the room becomes fixed target illuminance L0. Accordingly, the indoor lighting devices 2007 in a row S1 and a row S2, which are installed in a vicinity of the window, are hardly turned on brightly, and the indoor lighting devices 2007 are turned on by output which is increased as being deep inside the room, that is, in an order of a row S3, a row S4, and a row S5. As a result thereof, the desk top surfaces in the room are illuminated with a total of illuminance by the natural lighting and illuminance by the indoor lighting devices 2007, so that it is possible to achieve 750 lx (recommended maintained illuminance in an office according to "JIS Z9110 General rules of recommended lighting levels"), which is illuminance of a desk top surface regarded to be sufficient for working, throughout the whole of the room.

As described above, by using the daylighting device 2010 and the lighting control system (indoor lighting devices 2007) in combination, light is able to reach the deep inside of the room, so that it is possible to further increase brightness in the room and secure the illuminance of the desk top surface, which is regarded to be sufficient for working, throughout the whole of the room. Thus, a bright light environment which is much more stable is obtained without being affected by the seasons or weather.

INDUSTRIAL APPLICABILITY

An aspect of the invention is applicable to a daylighting slat, a daylighting device, and the like, which need to enhance rigidity while securing storability and weight reduction of the slat.

REFERENCE SIGNS LIST

1, 120 daylighting device
2 slat
3 support mechanism
4, 30, 40, 50, 60, 70, 80, 90, 100, 130 daylighting slat
81 first daylighting plate (first daylighting slat)
82 second daylighting plate (second daylighting slat)
5 daylighting portion
8, 11 base
8*a* surface
9*c* third surface part (reflecting surface)
K air layer
52 gap portion
L light
t thickness
24, 34, 44, 64, 74, 83, 91, 101 support member
25, 35, 65, 84, 85, 93 gripping portion
26, 46, 92, 102, 123 protective plate
51 daylighting plate
53 light diffusing film (light diffusing layer)

The invention claimed is:

1. A daylighting slat, comprising:

at least one daylighting plate having a long plate shape having long sides and short sides; and a support member that supports the at least one daylighting plate, wherein the at least one daylighting plate includes:

a base that has light transparency; and a plurality of daylighting parts that are provided on a first surface of the base, have light transparency and form a gap portion between the plurality of daylighting parts, wherein a part of a side surface of each of the plurality of daylighting parts, which is in contact with the gap portion, functions as a reflecting surface that reflects light entering the plurality of daylighting parts, and the support member, at least a part of which has light transparency, includes:

a gripping portion that grips the long sides of the at least one daylighting plate and has light absorbability; and a protective plate formed of a plate body that is provided so as to face a first surface or a second surface of the at least one daylighting plate and has light transparency.

2. The daylighting slat according to claim 1, wherein the at least one daylighting plate and the protective plate face each other via an air layer.

3. The daylighting slat according to claim 1, wherein the protective plate has a light diffusing property.

4. The daylighting slat according to claim 1, wherein a light diffusing layer is provided on a side opposite to the protective plate with the at least one daylighting plate arranged therebetween.

5. The daylighting slat according to claim 1, wherein a thickness of the protective plate changes along a transverse direction of the protective plate.

6. The daylighting slat according to claim 1, wherein the protective plate has ultraviolet absorbability, an ultraviolet reflecting property, or an infrared reflecting property.

7. The daylighting slat according to claim 1, wherein at least one daylighting plate area plurality of daylighting plates configurations of which are different from each other.

8. A daylighting device, comprising:

a plurality of slats; and a support mechanism that couples the plurality of slats so as to set a longitudinal direction of the plurality of slats to be in a horizontal direction and supports the plurality of slats in a hanging manner in a vertical direction, wherein at least a part of the plurality of slats is constituted by the daylighting slat according to claim 1.

9. The daylighting device according to claim 8, wherein the support mechanism supports the plurality of slats so as to be able to be lifted and lowered.

10. The daylighting device according to claim 8, wherein the support mechanism supports the plurality of slats such that tilt thereof is able to be adjusted.

11. The daylighting device according to claim 10, comprising:

a first daylighting slat that is provided for a part in an upper part side in the vertical direction among the plurality of slats; and a second daylighting slat that is provided for a part in a lower part side in the vertical direction, wherein light transmittance of the protective plate in the first daylighting slat.

12. The daylighting device according to claim 8, wherein the daylighting slat is provided for a part in an upper part side in the vertical direction among the plurality of slats.

13. The daylighting device according to claim 8, wherein the support member includes:

a first section that supports the daylighting part; and a second section that is not positioned in a same plane as a first surface or a second surface of the daylighting part.

14. The daylighting device according to claim 8, wherein, in a fully closed state, an overlap part of the plurality of slats that are adjacent to each other in the vertical direction is only the gripping portion.

15. A daylighting slat, comprising:

a daylighting plate; and a support member that supports the daylighting plate, wherein the daylighting plate includes:

a base that has light transparency; and a plurality of daylighting parts that are provided on a first surface of the base, have light transparency, and form a gap portion between the plurality of daylighting parts, wherein a part of a side surface of each of the plurality of daylighting parts, which is in contact with the gap portion, functions as a reflecting surface that reflects light entering the plurality of daylighting parts, and the support member, at least a part of which has light transparency, includes:

a gripping portion that grips at least a part of a peripheral part of the daylighting plate and has a light diffusing property; and a protective plate formed of a plate body that is provided so as to face a first surface or a second surface of the daylighting plate and has light transparency.

* * * * *